United States Patent [19]

Diana

[11] Patent Number: 4,932,589

[45] Date of Patent: Jun. 12, 1990

[54] METHOD OF AND APPARATUS FOR ELECTRICAL ISOLATION OF ELECTROSTATIC SPRAYERS

[75] Inventor: Michael J. Diana, Streamwood, Ill.

[73] Assignee: Binks Manufacturing Company, Franklin Park, Ill.

[21] Appl. No.: 251,327

[22] Filed: Sep. 30, 1988

[51] Int. Cl.[5] ..... B05B 5/02; B05B 17/04

[52] U.S. Cl. ..... 239/3; 118/302; 118/629; 239/68; 239/69; 239/112; 239/691; 427/27

[58] Field of Search ..... 239/3, 112, 113, 61, 239/68, 69, 305, 691, 708; 118/302, 629; 427/27

[56] References Cited

U.S. PATENT DOCUMENTS

| | | | |
|---|---|---|---|
| 3,348,774 | 10/1967 | Wiggins | 239/112 |
| 3,674,205 | 7/1972 | Kock | 239/112 |
| 3,937,400 | 2/1976 | Krause | 239/708 |
| 4,232,055 | 11/1980 | Shaffer | 239/3 |
| 4,275,834 | 6/1981 | Spanjersberg et al. | 239/3 |
| 4,337,282 | 6/1982 | Springer | 239/112 |
| 4,508,266 | 4/1985 | Saito et al. | 239/3 |
| 4,592,305 | 6/1986 | Scharfenberger | 239/112 |
| 4,771,729 | 9/1988 | Planert | 239/305 |
| 4,792,092 | 12/1988 | Elberson et al. | 239/3 |

*Primary Examiner*—Andres Kashnikow

*Assistant Examiner*—Michael J. Forman

*Attorney, Agent, or Firm*—Juettner Pyle Lloyd & Verbeck

[57] ABSTRACT

Apparatus for coupling a grounded color changer and associated supplies of conductive paint to an electrostatic paint sprayer isolates the color changer and paint supplies from a high voltage at the sprayer. The apparatus has at least one reservoir into which a metered volume of one color of paint to be sprayed is introduced while the reservoir and its contents are grounded. After charging the reservoir with paint and prior to supply of the paint to the sprayer, fluid lines between the reservoir and color changer are flushed to electrically isolate the reservoir and paint therein from the color changer and paint supplies. The reservoir and paint therein are then ungrounded and the paint is delivered to the sprayer for being emitted in an electrostatically charged atomized spray. At the end of spraying, the high voltage is removed from the sprayer and the reservoir and its contents are again grounded, following which the reservoir is purged of paint of the one color and reloaded with paint of another color. Advantageously, the apparatus has two reservoirs for alternately receiving and delivering selected colors of paint to the sprayer, so that one may be cleaned and reloaded with paint while the other delivers paint to the sprayer.

57 Claims, 13 Drawing Sheets

| FIG. 1A | FIG. 1B | FIG. 1C |
|---|---|---|

LOAD FIRST COLOR INTO RESERVOIR P

| | COLOR 1 | COLOR 2 | COLOR 3 | A | B | Z | C | B2 | Q |
|---|---|---|---|---|---|---|---|---|---|
| STEP 1 | 1 | 0 | 0 | 1 | 1 | 1 | 1 | 1 | 0 |
| 2 | 0 | 0 | 0 | 1 | 1 | 1 | 1 | 1 | 0 |

FIG. 2A

WATER PUSH FIRST COLOR TO RESERVOIR P

| | COLOR 1 | COLOR 2 | COLOR 3 | A | B | Z | C | B2 | Q |
|---|---|---|---|---|---|---|---|---|---|
| STEP 1 | 0 | 0 | 0 | 1 | 1 | 1 | 1 | 1 | 1 |
| 2 | 0 | 0 | 0 | 0 | 0 | 0 | 0 | 0 | 0 |

FIG. 2B

FLUSH PAINT AND DUMP BLOCK LINES TO ISOLATE RESERVOIR P

| | J | I | H | B | E | B2 | AI |
|---|---|---|---|---|---|---|---|
| STEP 1 | 1 | 1 | 1 | 1 | 1 | 1 | 0 |
| 2 | 1 | 0 | 1 | 1 | 1 | 1 | 1 |
| 3 | 1 | 1 | 1 | 1 | 1 | 1 | 0 |
| 4 | 1 | 0 | 1 | 1 | 1 | 1 | 0 |
| 5 | 1 | 1 | 1 | 1 | 1 | 1 | 0 |
| 6 | 1 | 0 | 1 | 1 | 1 | 1 | 0 |
| 7 | 1 | 1 | 1 | 1 | 1 | 1 | 0 |
| 8 | 0 | 0 | 1 | 1 | 1 | 1 | 0 |
| 9 | 0 | 0 | 1 | 1 | 1 | 1 | 0 |
| 10 | 0 | 0 | 1 | 1 | 1 | 1 | 0 |
| 11 | 0 | 0 | 1 | 1 | 1 | 1 | 0 |
| 12 | 0 | 0 | 0 | 0 | 0 | 0 | 0 |

FIG. 2C

PUSH PAINT FROM RESERVOIR PP AND SPRAY APPARATUS

| | H | JJ | KK | ZZ | FF | XX | M | D | YY | BI | OO |
|---|---|---|---|---|---|---|---|---|---|---|---|
| STEP 1 | 1 | 1 | 1 | 1 | 1 | 1 | 1 | 1 | 1 | 1 | 0 |

FIG. 2D

FLUSH LINES TO RESERVOIR PP AND PAINT SUPPLY AND DUMP RETURN LINES TO AND FROM SPRAY APPARATUS

| | J | I | H | JJ | BB | FF | XX | M | D | YY | BI | G |
|---|---|---|---|---|---|---|---|---|---|---|---|---|
| STEP 1 | 1 | 1 | 1 | 1 | 1 | 1 | 1 | 1 | 1 | 1 | 1 | 0 |
| 2 | 1 | 0 | 1 | 1 | 1 | 1 | 1 | 1 | 1 | 1 | 1 | 0 |
| 3 | 1 | 1 | 1 | 1 | 1 | 1 | 1 | 1 | 1 | 1 | 1 | 0 |
| 4 | 1 | 0 | 1 | 1 | 1 | 1 | 1 | 1 | 1 | 1 | 1 | 0 |
| 5 | 1 | 1 | 1 | 1 | 1 | 1 | 1 | 1 | 1 | 1 | 1 | 0 |
| 6 | 0 | 0 | 1 | 1 | 1 | 1 | 1 | 1 | 1 | 1 | 1 | 0 |
| 7 | 0 | 0 | 1 | 1 | 1 | 1 | 1 | 1 | 1 | 1 | 1 | 0 |
| 8 | 0 | 0 | 1 | 1 | 1 | 1 | 1 | 1 | 1 | 1 | 1 | 0 |
| 9 | 0 | 0 | 1 | 1 | 1 | 1 | 1 | 1 | 1 | 1 | 1 | 0 |
| 10 | 0 | 0 | 1 | 1 | 1 | 1 | 1 | 1 | 1 | 1 | 1 | 0 |
| 11 | 0 | 0 | 1 | 1 | 1 | 1 | 1 | 1 | 1 | 1 | 1 | 0 |
| 12 | 0 | 0 | 1 | 1 | 1 | 1 | 1 | 1 | 1 | 1 | 1 | 0 |
| 13 | 0 | 0 | 0 | 0 | 0 | 0 | 0 | 0 | 0 | 0 | 0 | 1 |

FIG. 2E

FLOW FIRST COLOR TO SPRAY DEVICE INLET FROM RESERVOIR P

| | H | K | Z | F | X | M | D | YY | BI |
|---|---|---|---|---|---|---|---|---|---|
| STEP 1 | 1 | 1 | 1 | 1 | 1 | 1 | 1 | 1 | 1 |
| 2 | 0 | 0 | 1 | 1 | 1 | 0 | 0 | 0 | 0 |

FIG. 2F

PRESSURIZE RESERVOIR P
AND BEGIN SPRAYING

| | W | PRESSURE A | PRESSURE B | PRESSURE C | O | HIGH VOLTAGE | SPRAY DEVICE | Z | F | X |
|---|---|---|---|---|---|---|---|---|---|---|
| STEP 1 | 1 | 1 | 0 | 0 | 1 | 1 | 1 | 1 | 1 | 1 |

FIG. 2G

PURGE COLOR CHANGER AND LINE ONE

| | U | Q | T | G |
|---|---|---|---|---|
| STEP 1 | 1 | 0 | 1 | 1 |
| 2 | 1 | 0 | 1 | 1 |
| 3 | 0 | 1 | 0 | 1 |
| 4 | 1 | 0 | 1 | 1 |
| 5 | 0 | 1 | 0 | 1 |
| 6 | 1 | 0 | 1 | 1 |
| 7 | 0 | 1 | 0 | 1 |
| 8 | 1 | 0 | 1 | 1 |
| 9 | 0 | 1 | 0 | 1 |
| 10 | 1 | 0 | 0 | 1 |
| 11 | 1 | 0 | 0 | 1 |
| 12 | 1 | 0 | 1 | 1 |

FIG. 2H

PURGE RESERVOIR PP

| | I | J | H | JJ | BB | KK | ZZ | EE | BI | CC |
|---|---|---|---|---|---|---|---|---|---|---|
| STEP 1 | 0 | 0 | 1 | 1 | 0 | 1 | 1 | 1 | 1 | 0 |
| 2 | 1 | 1 | 1 | 1 | 0 | 1 | 1 | 1 | 1 | 0 |
| 3 | 1 | 1 | 1 | 1 | 1 | 0 | 1 | 0 | 1 | 1 |
| 4 | 1 | 1 | 1 | 1 | 0 | 1 | 1 | 1 | 1 | 0 |
| 5 | 0 | 1 | 1 | 1 | 0 | 1 | 1 | 1 | 1 | 0 |
| 6 | 1 | 1 | 1 | 1 | 0 | 1 | 1 | 1 | 1 | 0 |
| 7 | 0 | 0 | 1 | 1 | 0 | 1 | 1 | 1 | 1 | 0 |
| 8 | 0 | 0 | 1 | 1 | 0 | 1 | 1 | 1 | 1 | 0 |
| 9 | 0 | 0 | 1 | 1 | 0 | 1 | 1 | 1 | 1 | 0 |
| 10 | 0 | 0 | 1 | 1 | 1 | 0 | 0 | 1 | 1 | 0 |

FIG. 2I

LOAD SECOND COLOR INTO RESERVOIR PP

| | COLOR 1 | COLOR 2 | COLOR 3 | A | JJ | BB | ZZ | CC | BI | Q |
|---|---|---|---|---|---|---|---|---|---|---|
| STEP 1 | 0 | 1 | 0 | 1 | 1 | 1 | 1 | 1 | 1 | 0 |

FIG. 2J

WATER PUSH SECOND COLOR TO RESERVOIR PP

| | COLOR 1 | COLOR 2 | COLOR 3 | A | JJ | BB | ZZ | CC | BI | Q |
|---|---|---|---|---|---|---|---|---|---|---|
| STEP 1 | 0 | 0 | 0 | 1 | 1 | 1 | 1 | 1 | 1 | 1 |
| 2 | 0 | 0 | 0 | 0 | 0 | 0 | 0 | 0 | 0 | 0 |

FIG. 2K

FLUSH PAINT AND DUMP BLOCK LINES TO ISOLATE RESERVOIR PP

| | J | I | H | JJ | BB | EE | BI | A2 |
|---|---|---|---|---|---|---|---|---|
| STEP 1 | 1 | 1 | 1 | 1 | 1 | 1 | 1 | 0 |
| 2 | 1 | 0 | 1 | 1 | 1 | 1 | 1 | 1 |
| 3 | 1 | 1 | 1 | 1 | 1 | 1 | 1 | 0 |
| 4 | 1 | 0 | 1 | 1 | 1 | 1 | 1 | 0 |
| 5 | 1 | 1 | 1 | 1 | 1 | 1 | 1 | 0 |
| 6 | 1 | 0 | 1 | 1 | 1 | 1 | 1 | 0 |
| 7 | 1 | 1 | 1 | 1 | 1 | 1 | 1 | 0 |
| 8 | 0 | 0 | 1 | 1 | 1 | 1 | 1 | 0 |
| 9 | 0 | 0 | 1 | 1 | 1 | 1 | 1 | 0 |
| 10 | 0 | 0 | 1 | 1 | 1 | 1 | 1 | 0 |
| 11 | 0 | 0 | 1 | 1 | 1 | 1 | 1 | 0 |
| 12 | 0 | 0 | 0 | 0 | 0 | 0 | 0 | 0 |

FIG. 2L

PUSH PAINT FROM RESERVOIR P

| | H | K | Z | F | X | M | D | Y | B2 | O |
|---|---|---|---|---|---|---|---|---|---|---|
| STEP 1 | 1 | 1 | 1 | 1 | 1 | 1 | 1 | 1 | 1 | 0 |

FIG. 2M

FLUSH LINES TO RESERVOIR P AND PAINT SUPPLY AND DUMP RETURN LINES TO AND FROM SPRAY APPARATUS

| | J | I | H | B | F | X | M | D | Y | B2 |
|---|---|---|---|---|---|---|---|---|---|---|
| STEP 1 | 1 | 1 | 1 | 1 | 1 | 1 | 1 | 1 | 1 | 1 |
| 2 | 1 | 0 | 1 | 1 | 1 | 1 | 1 | 1 | 1 | 1 |
| 3 | 1 | 1 | 1 | 1 | 1 | 1 | 1 | 1 | 1 | 1 |
| 4 | 1 | 0 | 1 | 1 | 1 | 1 | 1 | 1 | 1 | 1 |
| 5 | 1 | 1 | 1 | 1 | 1 | 1 | 1 | 1 | 1 | 1 |
| 6 | 0 | 0 | 1 | 1 | 1 | 1 | 1 | 1 | 1 | 1 |
| 7 | 0 | 0 | 1 | 1 | 1 | 1 | 1 | 1 | 1 | 1 |
| 8 | 0 | 0 | 1 | 1 | 1 | 1 | 1 | 1 | 1 | 1 |
| 9 | 0 | 0 | 1 | 1 | 1 | 1 | 1 | 1 | 1 | 1 |
| 10 | 0 | 0 | 1 | 1 | 1 | 1 | 1 | 1 | 1 | 1 |
| 11 | 0 | 0 | 1 | 1 | 1 | 1 | 1 | 1 | 1 | 1 |
| 12 | 0 | 0 | 1 | 1 | 1 | 1 | 1 | 1 | 1 | 1 |

FIG. 2N

FLOW SECOND COLOR TO SPRAY DEVICE INLET FROM RESERVOIR PP

| | H | JJ | KK | ZZ | FF | XX | M | D | Y | B2 |
|---|---|---|---|---|---|---|---|---|---|---|
| STEP 1 | 1 | 1 | 1 | 1 | 1 | 1 | 1 | 1 | 1 | 1 |
| 2 | 0 | 0 | 0 | 1 | 1 | 1 | 0 | 0 | 0 | 0 |

FIG. 20

PRESSURIZE RESERVOIR PP AND BEGIN SPRAYING

| | WW | PRESSURE A | PRESSURE B | PRESSURE C | 00 | HIGH VOLTAGE | SPRAY DEVICE | ZZ | FF | XX |
|---|---|---|---|---|---|---|---|---|---|---|
| STEP 1 | 1 | 1 | 0 | 0 | 1 | 1 | 1 | 1 | 1 | 1 |

FIG. 2P

PURGE COLOR CHANGER, LINE ONE AND RESERVOIR P

| | U | Q | T | G | | I | J | H | B | K | Z | C | E | B2 |
|---|---|---|---|---|---|---|---|---|---|---|---|---|---|---|
| STEP 1 | 1 | 0 | 1 | 1 | | 0 | 1 | 1 | 0 | 1 | 1 | 0 | 1 | 1 |
| 2 | 1 | 0 | 1 | 1 | | 1 | 1 | 1 | 0 | 1 | 1 | 0 | 1 | 1 |
| 3 | 0 | 1 | 0 | 1 | | 1 | 1 | 1 | 1 | 0 | 1 | 1 | 0 | 1 |
| 4 | 1 | 0 | 1 | 1 | | 1 | 1 | 1 | 0 | 1 | 1 | 0 | 1 | 1 |
| 5 | 0 | 1 | 0 | 1 | | 0 | 1 | 1 | 0 | 1 | 1 | 0 | 1 | 1 |
| 6 | 1 | 0 | 1 | 1 | | 1 | 1 | 1 | 0 | 1 | 1 | 0 | 1 | 1 |
| 7 | 0 | 1 | 0 | 1 | | 0 | 0 | 1 | 0 | 1 | 1 | 0 | 1 | 1 |
| 8 | 1 | 0 | 1 | 1 | | 0 | 0 | 1 | 0 | 1 | 1 | 0 | 1 | 1 |
| 9 | 0 | 1 | 0 | 1 | | 0 | 0 | 1 | 0 | 1 | 1 | 0 | 1 | 1 |
| 10 | 1 | 0 | 0 | 1 | | 0 | 0 | 1 | 1 | 0 | 0 | 0 | 1 | 1 |
| 11 | 1 | 0 | 0 | 1 | | | | | | | | | | |
| 12 | 1 | 0 | 1 | 1 | | | | | | | | | | |

FIG. 2Q

PURGE RESERVOIR P AND FLUID LINES TO SPRAY DEVICE WITH WATER

| | I | H | B | K | Z | F | X | M | D | Y | B2 | C |
|---|---|---|---|---|---|---|---|---|---|---|---|---|
| STEP 1 | 0 | 1 | 0 | 1 | 1 | 1 | 1 | 1 | 1 | 1 | 1 | 0 |
| 2 | 1 | 1 | 0 | 1 | 1 | 1 | 1 | 1 | 1 | 1 | 1 | 0 |
| 3 | 1 | 1 | 1 | 0 | 1 | 0 | 0 | 0 | 0 | 0 | 1 | 1 |
| 4 | 1 | 1 | 0 | 1 | 1 | 1 | 1 | 1 | 1 | 1 | 1 | 0 |
| 5 | 0 | 1 | 0 | 1 | 1 | 1 | 1 | 1 | 1 | 1 | 1 | 0 |
| 6 | 0 | 1 | 0 | 1 | 1 | 1 | 1 | 1 | 1 | 1 | 1 | 0 |
| 7 | 0 | 1 | 0 | 1 | 1 | 1 | 1 | 1 | 1 | 1 | 1 | 0 |
| 8 | 0 | 1 | 0 | 1 | 1 | 1 | 1 | 1 | 1 | 1 | 1 | 0 |
| 9 | 0 | 1 | 0 | 1 | 1 | 1 | 1 | 1 | 1 | 1 | 1 | 0 |

FIG. 3A

PURGE RESERVOIR PP AND FLUID LINES TO SPRAY DEVICE WITH WATER

| | I | H | JJ | BB | KK | ZZ | FF | XX | M | D | YY | BI | CC |
|---|---|---|---|---|---|---|---|---|---|---|---|---|---|
| STEP 1 | 0 | 1 | 1 | 0 | 1 | 1 | 1 | 1 | 1 | 1 | 1 | 1 | 0 |
| 2 | 1 | 1 | 1 | 0 | 1 | 1 | 1 | 1 | 1 | 1 | 1 | 1 | 0 |
| 3 | 1 | 1 | 1 | 1 | 0 | 1 | 0 | 0 | 0 | 0 | 0 | 1 | 1 |
| 4 | 1 | 1 | 1 | 0 | 1 | 1 | 1 | 1 | 1 | 1 | 1 | 1 | 0 |
| 5 | 0 | 1 | 1 | 0 | 1 | 1 | 1 | 1 | 1 | 1 | 1 | 1 | 0 |
| 6 | 0 | 1 | 1 | 0 | 1 | 1 | 1 | 1 | 1 | 1 | 1 | 1 | 0 |
| 7 | 0 | 1 | 1 | 0 | 1 | 1 | 1 | 1 | 1 | 1 | 1 | 1 | 0 |
| 8 | 0 | 1 | 1 | 0 | 1 | 1 | 1 | 1 | 1 | 1 | 1 | 1 | 0 |
| 9 | 0 | 1 | 1 | 0 | 1 | 1 | 1 | 1 | 1 | 1 | 1 | 1 | 0 |

FIG. 3B

LOAD AND WATER PUSH COLOR 1 INTO RESERVOIR P

| | COLOR 1 | A | B | Z | C | B2 | I | H |
|---|---|---|---|---|---|---|---|---|
| STEP 1 | 1 | 1 | 1 | 1 | 1 | 1 | 0 | 0 |
| 2 | 0 | 0 | 1 | 1 | 1 | 1 | 1 | 1 |
| 3 | 0 | 0 | 0 | 0 | 0 | 0 | 0 | 0 |

FIG. 4A

LOAD AND WATER PUSH COLOR 1 INTO RESERVOIR PP

| | COLOR 1 | A | JJ | BB | ZZ | CC | BI | I | H |
|---|---|---|---|---|---|---|---|---|---|
| STEP 1 | 1 | 1 | 1 | 1 | 1 | 1 | 1 | 0 | 0 |
| 2 | 0 | 0 | 1 | 1 | 1 | 1 | 1 | 1 | 1 |
| 3 | 0 | 0 | 0 | 0 | 0 | 0 | 0 | 0 | 0 |

FIG. 4B

TERMINATE SPRAYING FROM RESERVOIR P

| | W | PRESSURE A | PRESSURE B | PRESSURE C | O | HIGH VOLTAGE | SPRAY DEVICE | Z | F | X |
|---|---|---|---|---|---|---|---|---|---|---|
| STEP 1 | 0 | 0 | 0 | 0 | 0 | 0 | 0 | 0 | 0 | 0 |

FIG. 4C

FLOW COLOR 1 TO MANIFOLD FROM RESERVOIR PP

| | H | JJ | KK | ZZ | FF | XX | DD | Y | B2 |
|---|---|---|---|---|---|---|---|---|---|
| STEP 1 | 1 | 1 | 1 | 1 | 1 | 1 | 1 | 1 | 1 |

FIG. 4D

ISOLATE RESERVOIR PP FROM THE MANIFOLD

| STEP | J | I | H | B | F | X | DD | Y | B2 |
|---|---|---|---|---|---|---|---|---|---|
| 1 | 1 | 1 | 1 | 1 | 1 | 1 | 1 | 1 | 1 |
| 2 | 1 | 0 | 1 | 1 | 1 | 1 | 1 | 1 | 1 |
| 3 | 1 | 1 | 1 | 1 | 1 | 1 | 1 | 1 | 1 |
| 4 | 1 | 0 | 1 | 1 | 1 | 1 | 1 | 1 | 1 |
| 5 | 1 | 1 | 1 | 1 | 1 | 1 | 1 | 1 | 1 |
| 6 | 0 | 0 | 1 | 1 | 1 | 1 | 1 | 1 | 1 |
| 7 | 0 | 0 | 1 | 1 | 1 | 1 | 1 | 1 | 1 |
| 8 | 0 | 0 | 1 | 1 | 1 | 1 | 1 | 1 | 1 |
| 9 | 0 | 0 | 1 | 1 | 1 | 1 | 1 | 1 | 1 |
| 10 | 0 | 0 | 1 | 1 | 1 | 1 | 1 | 1 | 1 |
| 11 | 0 | 0 | 1 | 1 | 1 | 1 | 1 | 1 | 1 |
| 12 | 0 | 0 | 1 | 1 | 1 | 1 | 1 | 1 | 1 |
| 13 | 0 | 0 | 0 | 0 | 0 | 0 | 0 | 0 | 0 |

FIG. 4E

TERMINATE SPRAYING FROM RESERVOIR PP

| STEP | WW | PRESSURE A | PRESSURE B | PRESSURE C | 00 | HIGH VOLTAGE | SPRAY DEVICE | ZZ | FF | XX |
|---|---|---|---|---|---|---|---|---|---|---|
| 1 | 0 | 0 | 0 | 0 | 0 | 0 | 0 | 0 | 0 | 0 |

FIG. 4F

FLOW COLOR 1 TO MANIFOLD FROM RESERVOIR P

| STEP | H | K | Z | F | X | DD | YY | BI |
|---|---|---|---|---|---|---|---|---|
| 1 | 1 | 1 | 1 | 1 | 1 | 1 | 1 | 1 |

FIG. 4G

ISOLATE RESERVOIR PP FROM THE MANIFOLD

| | J | I | H | JJ | BB | FF | XX | DD | YY | BI |
|---|---|---|---|---|---|---|---|---|---|---|
| STEP 1 | 1 | 1 | 1 | 1 | 1 | 1 | 1 | 1 | 1 | 1 |
| 2 | 1 | 0 | 1 | 1 | 1 | 1 | 1 | 1 | 1 | 1 |
| 3 | 1 | 1 | 1 | 1 | 1 | 1 | 1 | 1 | 1 | 1 |
| 4 | 1 | 0 | 1 | 1 | 1 | 1 | 1 | 1 | 1 | 1 |
| 5 | 1 | 1 | 1 | 1 | 1 | 1 | 1 | 1 | 1 | 1 |
| 6 | 0 | 0 | 1 | 1 | 1 | 1 | 1 | 1 | 1 | 1 |
| 7 | 0 | 0 | 1 | 1 | 1 | 1 | 1 | 1 | 1 | 1 |
| 8 | 0 | 0 | 1 | 1 | 1 | 1 | 1 | 1 | 1 | 1 |
| 9 | 0 | 0 | 1 | 1 | 1 | 1 | 1 | 1 | 1 | 1 |
| 10 | 0 | 0 | 1 | 1 | 1 | 1 | 1 | 1 | 1 | 1 |
| 11 | 0 | 0 | 1 | 1 | 1 | 1 | 1 | 1 | 1 | 1 |
| 12 | 0 | 0 | 1 | 1 | 1 | 1 | 1 | 1 | 1 | 1 |
| 13 | 0 | 0 | 0 | 0 | 0 | 0 | 0 | 0 | 0 | 0 |

FIG. 4H

PURGE COLOR CHANGER

| | U | GG | T | G |
|---|---|---|---|---|
| STEP 1 | 1 | 0 | 1 | 1 |
| 2 | 1 | 0 | 1 | 1 |
| 3 | 0 | 1 | 0 | 1 |
| 4 | 1 | 0 | 1 | 1 |
| 5 | 0 | 1 | 0 | 1 |
| 6 | 1 | 0 | 1 | 1 |
| 7 | 0 | 1 | 0 | 1 |
| 8 | 1 | 0 | 1 | 1 |
| 9 | 0 | 1 | 0 | 1 |
| 10 | 1 | 0 | 0 | 1 |
| 11 | 1 | 0 | 0 | 1 |
| 12 | 1 | 0 | 1 | 1 |
| 13 | 0 | 0 | 0 | 0 |

FIG. 5

METHOD OF AND APPARATUS FOR ELECTRICAL ISOLATION OF ELECTROSTATIC SPRAYERS

BACKGROUND OF THE INVENTION

The present invention relates to color changers for spray coating equipment, and in particular to a method of and apparatus for coupling a grounded color changer and associated supplies of conductive paint to electrostatic spraying equipment, while maintaining electrical isolation between a high voltage at the spraying equipment and the color changer and paint supplies.

Color changers for spray coating apparatus have application in industrial operations where articles are to be spray coated at a station or as they move along a production line. Where the articles are to be coated a wide variety of colors, it generally is not practical to establish separate spray stations or production lines for each color, or even to spray a long sequence of articles one color, then another long sequence a second color, etc. Instead, it is desirable to be able to make color changes rapidly and simply at a single station.

Electrostatic spray coating devices have an increased painting efficiency over nonelectrostatic types. When painting with an electrostatic spraying apparatus, it is necessary to have some means for applying a charge to the paint. In some apparatus, charging is accomplished by an electrode connected to a high voltage supply and placed in close proximity to or in contact with the paint either just prior or close to its point of atomization. In rotary atomization apparatus, the rotary atomizer is ordinarily made of a conductive material and connected to the power supply, so the atomizer itself is the electrode. Whichever type of apparatus is used, the charging potential is usually on the order of several tens of kilovolts, and the electrostatic charging process works well when spraying nonconductive paints. However, when spraying conductive paints, such as water based paints, precautions must be taken to prevent the high voltage at the spraying apparatus from shorting to ground through a conductive column of paint being delivered to the spraying apparatus.

One known approach to prevent shorting the high voltage to ground is to isolate the entire paint supply and color change system from ground potential. This allows the paint system to "float" at the charging potential, but has the drawback that a large amount of electrical energy is capacitively stored in the system. To prevent the capacitively stored energy from presenting a shock hazard to operating personnel, it is necessary to provide a protective enclosure around the color changer and paint supplies, which increases costs and requires that the spraying operation be shut down and the system electrically discharged whenever necessary to replenish the supplies of paint. Also, during operation of the system, the large amount of capactively stored energy increases the probability of arcing and the possibility of an explosion when volatile paints are sprayed.

Another approach, which can be used when the paint is relatively nonconductive, is to ground the paint supplies and color changer and connect the spraying apparatus to the color changer through a hose of sufficient length that the electrical resistance of the paint column in the hose is large enough to reduce current leakage through the paint column to a level that does not short out the charging voltage or cause it to fall to an unacceptably low level. A disadvantage of the approach is that the hose, due to its extended length, is hard to manage and difficult to clean during color changes. Also, while the extended length of the hose limits the magnitude of leakage current, some leakage nonetheless occurs and represents "wasted" charging energy. For relatively conductive coating materials, such as waterborne paints, the resistance of the paint is so low that the technique is not practical.

OBJECTS OF THE INVENTION

An object of the present invention is to provide an isolation system for connection between a grounded color changer and an electrostatic spray coating apparatus, which electrically isolates the color changer and associated paint supplies from a high voltage at the spray apparatus, so that even when the paints are conductive, there is no leakage of charging current from the spray apparatus to the color changer and paint supplies.

Another object is to provide such an isolation system, which may readily be cleaned of one color of paint in preparation for supplying another color to the spray apparatus.

A further object is to provide such an isolation system, in which only a limited metered quantity of paint is charged to the high voltage during a spraying operation.

Yet another object is to provide such an isolation system, in which paint in the system is grounded whenever the high voltage is removed from the spray apparatus.

SUMMARY OF THE INVENTION

In accordance with the present invention, a system for supplying selected ones of a plurality of electrically conductive coating materials to high voltage electrostatic coating apparatus comprises a color changer having inlets for connection with a plurality of supplies of coating materials and an outlet. A reservoir is connectable to the coating apparatus, and coupling means connects the color changer outlet to the reservoir. Means are provided for operating the color changer to flow coating material from a selected one of the supplies from the color changer outlet into and through the coupling means to and into the reservoir, as well as means for flushing at least a portion of the coupling means between the color changer outlet and reservoir, after the color changer flows coating material through the coupling means to the reservoir, to electrically isolate coating material in the reservoir from the color changer and coating material supplies. In addition, included are means, operative after coating material in the reservoir has been electrically isolated from the color changer and supplies, for delivering coating material in the reservoir to the coating apparatus for being electrostatically charged and emitted by the coating apparatus, whereby the high voltage at the coating apparatus is electrically isolated from the color changer and supplies of coating materials.

In one contemplated embodiment, means is also provided, which is operative after the color changer flows coating material through the coupling means to the reservoir and before at least a portion of the coupling means is flushed, for introducing a solvent for the coating material into the coupling means at the color changer outlet to push coating material remaining in the coupling means to and into the reservoir. Advantageously, the volume of coating material flowed by the color changer into the coupling means is measured, and the flow is stopped after a preselected volume has been measured. The coupling means has a known volumetric capacity, the volume of solvent introduced into the coupling means is also measured, and introduction of solvent into the coupling means is terminated upon the measured volume of solvent being substantially equal to the known volumetric capacity. The reservoir is therefore filled with the preselected volume of coating material, which preferably is an amount just sufficient for a particular coating operation.

For safety purposes, means are provided for grounding the contents of the reservoir whenever coating material in the reservoir is not being delivered to and electrostatically charged by the coating apparatus.

The invention also contemplates a system in which there are two reservoirs, such that one delivers one selected coating material to the coating apparatus for being electrostatically charged and emitted by the coating apparatus while the other is cleaned and refilled with the next selected coating material to be delivered to the coating apparatus.

According to a method of the invention, selected ones of a plurality of electrically conductive coating materials are supplied to high voltage electrostatic coating apparatus with a color changer having inlets for connection with respective supplies of coating materials and an outlet, while maintaining electrical isolation between the high voltage at the coating apparatus and the color changer and supplies of coating material. The method comprises the steps of coupling the color changer outlet to a reservoir through a supply path; connecting the reservoir to the coating apparatus through a delivery path; and operating the color changer to flow coating material from a selected one of the supplies from the color changer outlet into and through the supply path to and into the reservoir. After completion of flow of coating material from the color changer outlet, at least a portion of the supply path between the color changer outlet and reservoir is flushed to electrically isolate coating material in the reservoir from the color changer and the supplies. Next, and after coating material in the reservoir is isolated from the color changer, it is delivered from the reservoir through the delivery path to the coating apparatus for being electrostatically charged and emitted thereby. In this manner, the high voltage at the coating apparatus is electrically isolated from the color changer and supplies of coating material.

In a contemplated embodiment of the method, after the color changer flows coating material into and through the supply path to and into the reservoir, and before at least a portion of the supply path is flushed, solvent for the coating material is introduced into the supply path, at the color changer outlet, to push coating material remaining in the supply path to and into the reservoir. The volume of coating material flowed from the color changer outlet into the supply path is measured, and when it equals a preselected amount the flow is interrupted. The volume of solvent then introduced into the supply path also is measured, and when it substantially equals a known volumetric capacity of the supply path the introducing step is terminated. In this manner, the reservoir is loaded with the predetermined amount of coating material, which preferably is an amount just sufficient for a particular coating operation.

For safety purposes the contents of the reservoir are grounded whenever coating material in the reservoir is not being delivered to and electrostatically charged by the coating apparatus.

The method also contemplates the use of two separate reservoirs, such that while one delivers coating material to the coating apparatus the other is cleaned and refilled with the next selected coating material to be delivered to the coating apparatus. Using two reservoirs shortens the time required to deliver different selected coating materials to the coating apparatus.

The foregoing and other objects, advantages and features of the invention will become apparent upon a consideration of the following detailed description, when taken in conjunction with the accompanying drawings.

BRIEF DESCRIPTION OF THE DRAWINGS

FIGS. 2A–2Q are truth tables showing a contemplated operation of the isolation system in delivering different colors of paint to the spray apparatus;

FIGS. 3A and 3B are truth tables showing selected modes of operation of the isolation system;

FIGS. 4A–4H are truth tables showing portions of a contemplated mode of operation of the isolation system in successively delivering metered quantities of the same color of paint to the spray apparatus, and FIG. 5 is a truth table showing a technique for cleaning the color changer assembly.

DETAILED DESCRIPTION

Figure 1A:
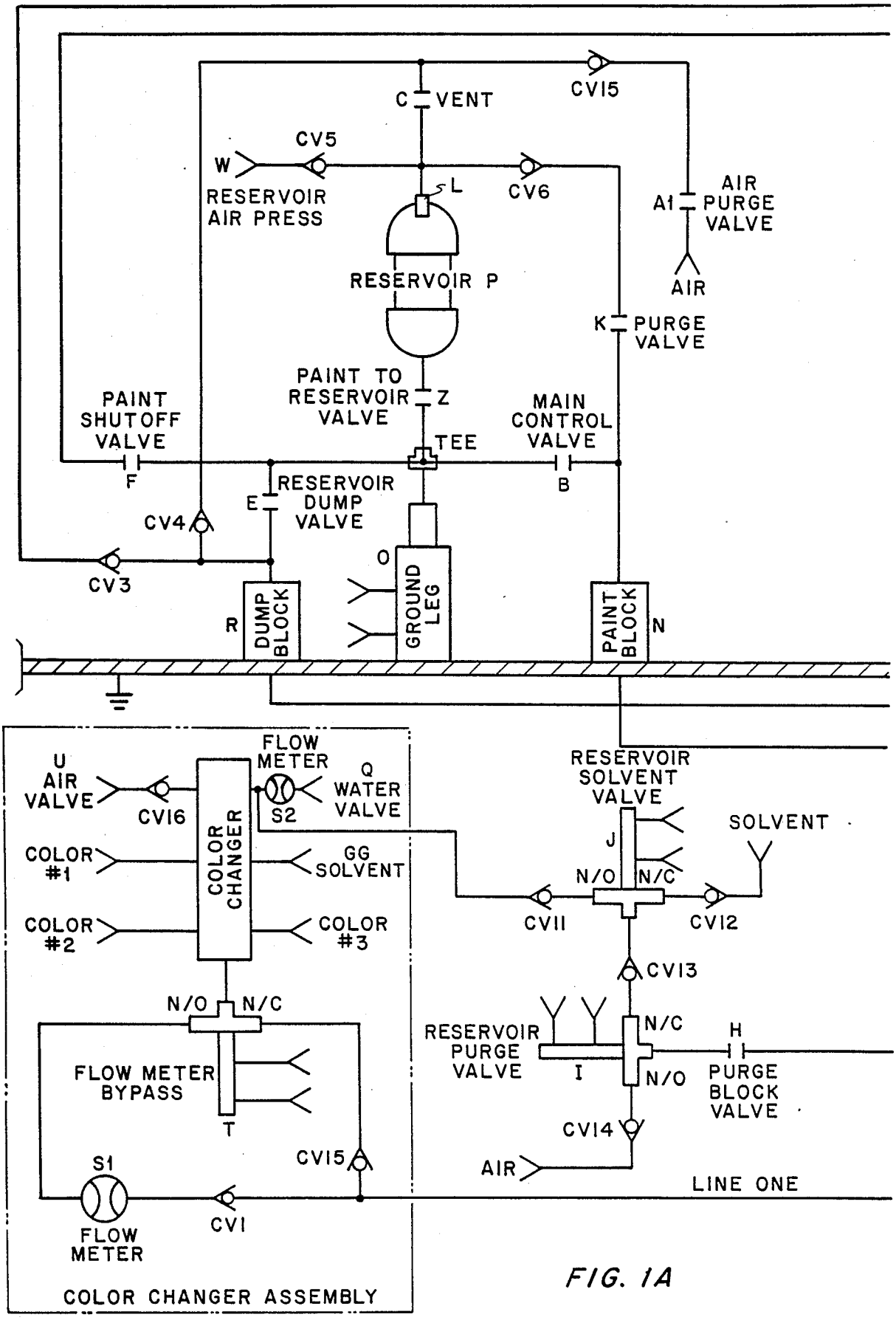
FIGS. 1 and 1A–1C schematically represent an isolation system according to the invention, for being connected between a color changer assembly and an electrostatic spray apparatus for delivering metered quantities of paint from the color changer to the spray apparatus and for electrically isolating the color changer and its associated supplies of paint from a high electrostatic charging voltage at the spray apparatus.
Figure 1B:
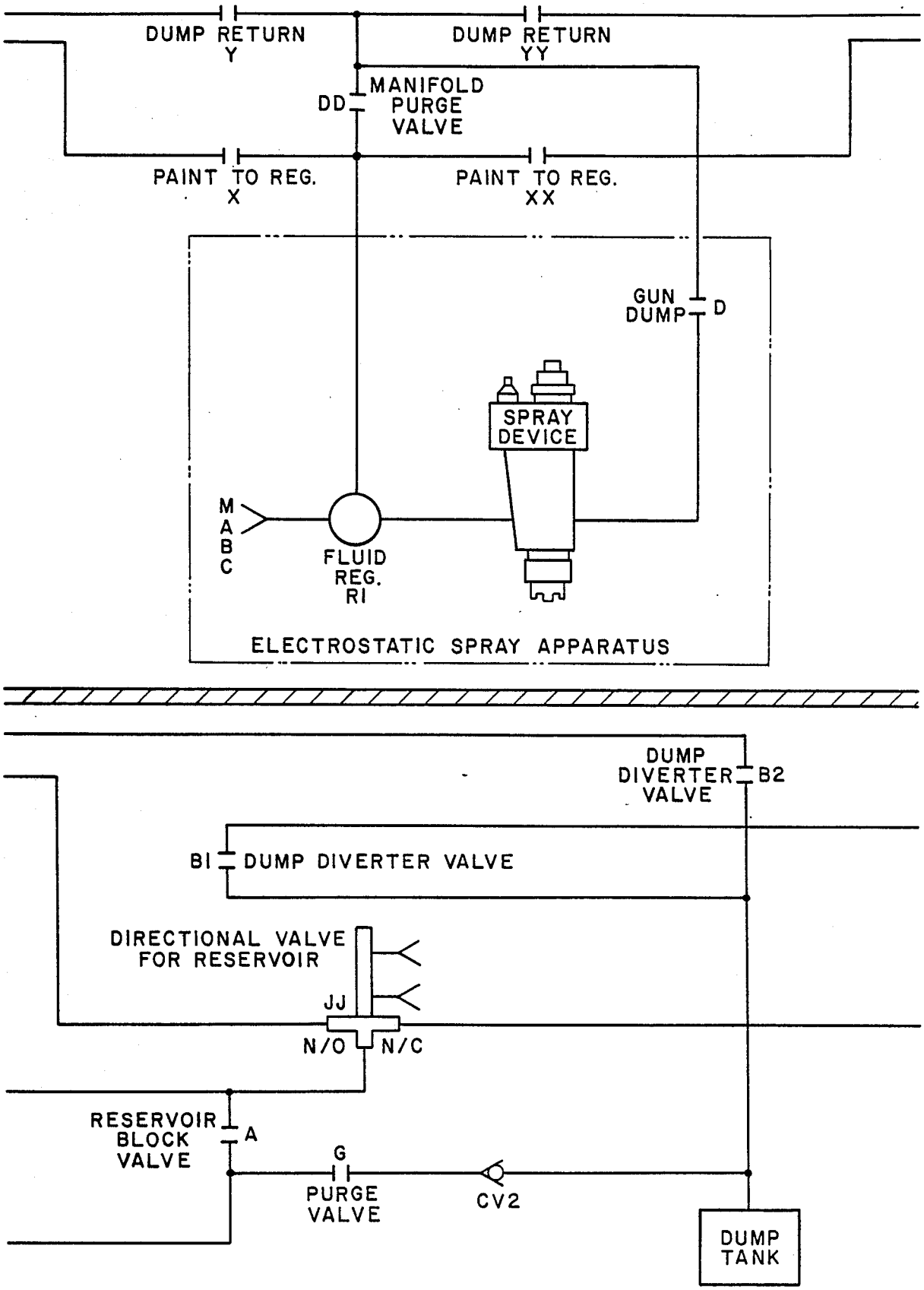
Figures 1, 1C:
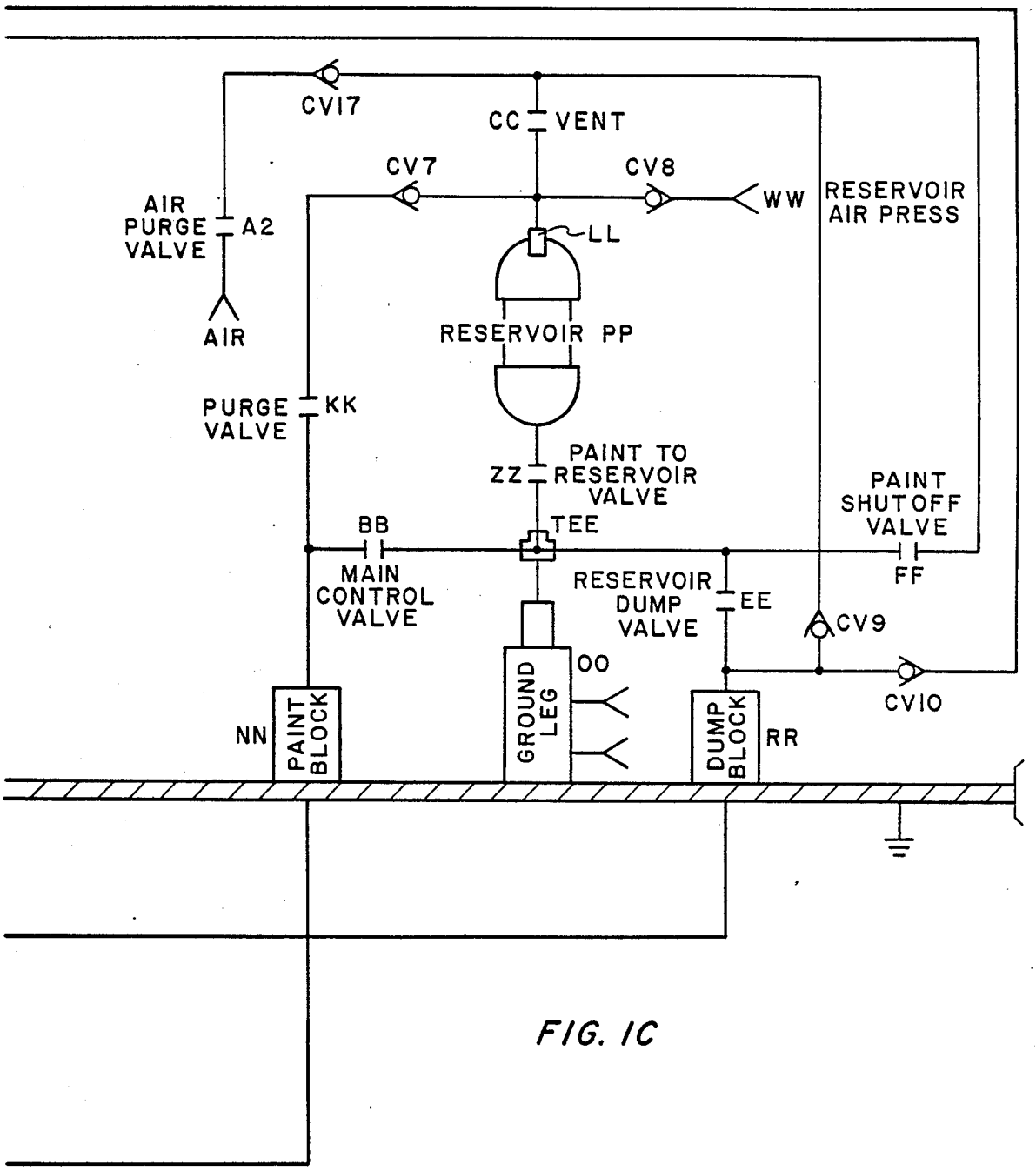

FIGS. 1A–1C schematically show a high voltage electrostatic spray apparatus that includes a spray device or gun adapted to spray any one of a plurality of different colors of paints. Also shown is a grounded color changer assembly that is operable to selectively supply any one of a number of different colors of paint to the spray apparatus. The color changer assembly is not connected directly to the spray apparatus, but rather is connected through an isolation system constructed and operated according to the teachings of the invention. Paint provided by the color changer assembly may be electrically nonconductive, but the isolation system uniquely adapts it to supply conductive paint to the spray apparatus, while maintaining electrical isolation of the grounded color changer and its paint supplies from the high voltage at the spray apparatus.

The isolation system has been developed primarily for color changing water based paints supplied to electrostatic spray coating apparatus. Previously, when spraying water based paints electrostatically, any paint supply pumps, pressure pots, color changers, paint supplies, etc., had to be isolated from ground by means of isolation stands. The isolation system of the invention, however, advantageously enables all such components and paint supplies to remain at ground potential, and charges only as much paint as is required to spray a specific job. This greatly reduces the hazard of a high capacitance electrical discharge and provides an effective, safe and economical manner in which to apply water based paints electrostatically.

The isolation system may have two or more appropriately sized reservoirs that are filled with metered volumes of selected colors of paint as required for specific jobs. A single reservoir could be used, but by using two or more the time required to change colors of paint delivered to the spray apparatus is significantly reduced. The illustrated isolation system has two such reservoirs P and PP, which alternately are charged with and deliver selected colors of paint to the spray apparatus. The color changer and its paint supplies are grounded, and once a reservoir is filled with paint, it is electrically isolated from the color changer and paint supplies by cleaning the fluid lines between it and the color changer. For safety purposes, pneumatically operated ground legs O and OO are attached to respective reservoirs to ground their contents during fill and purge cycles. While paint is being delivered from a reservoir and sprayed by the gun, its ground leg removes ground from its contents, so that the high charging voltage at the gun is not shorted out. For added safety, the only time the contents of a reservoir are not grounded is when the reservoir is delivering paint to the spray gun and a high electrostatic charging voltage is present at the gun.

While paint in the one reservoir is delivered to the spray apparatus, the other reservoir is purged of the color of paint it previously delivered and then filled with a metered volume of the next color of paint to be delivered. This simultaneous action enables the isolation system to accommodate short duration purge and fill requirements between color changes. In the event of an electrostatic power supply overload, the ground legs O and OO ground the reservoirs to eliminate the possibility of a high capacitance discharge.

The isolation system of the invention may be positioned between a conventional color changer assembly and a conventional electrostatic spray apparatus, and therefore is readily adapted for use with existing color changer assemblies and electrostatic spray apparatus. More particularly, as seen in FIGS. 1A–1C, a grounded conventional color changer assembly includes a color changer having a plurality of inlets connected to a corresponding plurality of grounded supplies of different colors of conductive paints or coating materials, which as described are water based paints and of which colors 1, 2 and 3 represent three of a large number of different colors. The color changer operates in a known manner to selectively supply any one of the colors of paint at its outlet, and has a valved water inlet Q connected to a source of water, which is a solvent for water based paints, through a flow meter S2, a valved air inlet U that includes a check valve CV16, and a valved chemical solvent inlet GG. An outlet from the color changer connects to an inlet to a pneumatically actuable flow meter bypass valve T, a normally closed outlet from which connects through a check valve CV15 to a LINE ONE of the isolation system and a normally open outlet from which connects through a flow meter S1 and a check valve CV1 to the LINE ONE. The flow meter bypass valve, flow meters and check valves are illustrated as part of the color changer assembly, but if the particular color changer assembly used does not otherwise have such components, they would be provided as part of the isolation system.

The color changer assembly provides selected colors of paint through the isolation system to a conventional spray apparatus, which as shown includes an electrostatic atomization spray device or gun, a pneumatically controlled fluid regulator R1 for controlling the pressure of paint at an inlet to the gun in accordance with a pneumatic signal at a control inlet to the regulator, and a pneumatically controlled gun dump valve D in line with a flush outlet from the gun.

The isolation system connects between the color changer assembly and spray apparatus to convey selected colors of paint to the spray apparatus while isolating the color changer and its associated paint supplies from the high charging voltage at the spray apparatus. If the color changer assembly is an existing one that already includes the flow meter bypass valve T, flow meters S1 and S2 and check valves CV1, CV15 and CV16, then the inlet to the isolation system from the color changer assembly is at the inlet to LINE ONE, i.e., at the outlets from the check valves CV1 and CV15. If the color changer assembly does not already include the flow meter bypass valve, flow meters and check valves, then the isolation system would itself include those components and its inlet would be at the outlet from the color changer.

Considering the structure of the isolation system in greater detail, it includes a plurality of valves and fluid lines or hoses of electrically insulating material. The LINE ONE extends between the outlet from the color changer assembly and inlets to a pneumatically controlled reservoir block valve A and a pneumatically controlled color changer purge valve G. An outlet from the purge valve connects through a check valve CV2 to a dump tank, and an outlet from the reservoir block valve connects to an inlet to a pneumatically controlled directional valve JJ for the reservoirs P and PP, which reservoirs also are of electrically insulating material. Also connected to the inlet to the directional valve is an outlet from a pneumatically controlled purge block valve H, an inlet to which connects to an outlet from a pneumatically controlled reservoir purge valve I. A normally open inlet to the reservoir purge valve connects through a check valve CV14 to a supply of air under pressure, and a normally closed inlet connects through a check valve CV13 to an outlet from a pneumatically controlled reservoir solvent valve J. A normally open inlet to the solvent valve connects to the supply of water through a check valve CV11 and the flow meter S2, and a normally closed inlet connects through a check valve CV12 to a pressurized supply of solvent.

Downstream from the reservoir directional valve JJ the isolation system has two symmetrical parts, one including the reservoir P and the other the reservoir PP. The reservoirs are adapted to receive metered volumes of paint for delivery to the spray apparatus, with each metered volume being only that amount of paint necessary for a particular spraying operation. As will be described, paint is alternately delivered to the spray gun first from one reservoir and then from the other, and while one reservoir is delivering paint the other is being flushed clean of the color of paint it previously delivered. A normally open outlet from the reservoir directional valve JJ connects to the symmetrical part of the isolation system including the reservoir P and a normally closed outlet connects to the part including the reservoir PP.

The two symmetrical parts of the isolation system are identical, so only the structure of the one with single reference letters and including the reservoir P will be described, it being understood that a like description applies to the other part, the components of which are identified by similar but double reference letters. Accordingly, the normally open outlet from the reservoir directional valve JJ connects to an inlet to a paint block N, which is a manifold of electrically insulating material mounted on an electrically conductive and grounded platform. An outlet from the paint block connects to inlets to a pneumatically controlled main control valve B and a pneumatically controlled purge valve K. An outlet from the valve B connects through a tee of electrically conductive material to one side of a pneumatically controlled paint to reservoir valve Z and to inlets to each of a pneumatically controlled reservoir dump valve E and a pneumatically controlled paint shutoff valve F. Also connected to the tee and mounted on the grounded platform is the ground leg O, which is selectively deactuable and actuable to connect and disconnect the tee with and from ground potential.

An outlet from the paint shutoff valve F connects through a pneumatically controlled paint to regulator valve X to an inlet to the fluid regulator R1 of the spray apparatus, the outlet from which connects to a paint inlet to the spray device. A dump or flush outlet from the spray device connects through the gun dump valve D, a pneumatically controlled dump return valve Y and a check valve CV3 to an inlet to a dump block R, which is a manifold of electrically insulating material mounted on the grounded platform. An outlet from the reservoir dump valve E also connects to the inlet to the dump block, and an outlet from the dump block connects through a pneumatically controlled dump diverter valve B2 to the dump tank. Connected between the outlet from the valve X and the inlet to the valve Y is a pneumatically controlled manifold purge valve DD that is common to both symmetrical parts.

A lower inlet/outlet end of the reservoir P is connected through the valve Z to the electrically conductive tee T. An upper inlet/outlet end of the reservoir includes a diffuser L, and is connected to an outlet from the purge valve K through a check valve CV6, to a regulated reservoir air pressure valve W through a check valve CV5, through a pneumatically controlled vent valve C and a check valve CV15 to a pneumatically controlled air purge valve A1, and through the vent valve C and a check valve CV4 to the inlet to the dump block R.

The second symmetrical part of the isolation system is structured identically to the first part, and components of the second part identified with double reference letters correspond to components of the first part identified with the same but single reference letters. Also, check valves CV7, CV8, CV9, CV10 and CV17 of the second part correspond, respectively, with the check valves CV6, CV5, CV4, CV3 and CV15 of the first part; a pneumatically controlled air purge valve A2 of the second part corresponds to the valve A1 of the first part; and a pneumatically controlled dump diverter valve B1 of the second part corresponds to the valve B2 of the first part.

Considering operation of the isolation system in delivering paint from the color changer assembly to the spray apparatus and in isolating the grounded color changer assembly and its associated grounded paint supplies from the high voltage at the spray apparatus during a spraying operation, and starting with an empty system, as an initial step a first selected color of paint, for example color 1, is loaded into the reservoir P. As seen in FIG. 2A, this is accomplished by admitting paint of color 1 into the color changer, while simultaneously actuating or opening the valves A, B, Z, C and B2 to establish both a flow path for color 1 from the color changer to and into the lower end of the reservoir P and a vent path for air out of the upper end of the reservoir as it is displaced by paint. The volume flow of paint is measured by the flow meter S1, and is limited to only as much paint as is necessary to complete a particular spraying operation. In essence, when the volume flow of paint through the flow meter S1, together with a known volume of paint that exists between the color changer and flow meter, equals a predetermined volume, the color changer valve for color 1 is closed.

At this point, a column of paint of known volume extends between the color changer and the lower end of the reservoir P. The column of paint comprises a portion of the total charge to be loaded into the reservoir, and as seen in FIG. 2B is pushed from the color changer and into the reservoir by opening the color changer water valve Q. When the water valve is opened, the flow meter S2 measures the volume flow of water through it, and when it measures a selected volume flow, the valves A, B, Z, C, B2 and Q are deactuated and closed. The selected volume flow is almost but not quite equal to the volume of the column of paint that extended between the color changer and reservoir, so when the valves are closed a column of water then extends from the color changer to a point close to but not quite at the lower end of the reservoir, for example to the valve Z. In the process of pushing the column of paint to and into the reservoir, the water advantageously partially cleans the flow path between the color changer and reservoir.

Because of the column of water and a limited amount of paint residue extending between the color changer and reservoir P, an electrically conductive path exists between the reservoir and color changer. The color changer and its associated paint supplies are electrically grounded for safety, so to electrically isolate the reservoir from ground, i.e., from the color changer, paint supplies, grounded plate and components of the isolation system on the color changer assembly side of the grounded plate, the column of water and paint residue are flushed from the paint block N, the dump block R and their associated lines. This is accomplished, as seen in FIG. 2C, by actuating the valves J, H, B, E and B2 to establish a flow path from the valve H and through the valve JJ, paint block N, valve B, tee, valve E, dump block R and valve B2 to the dump tank, while alternately actuating and deactuating the valve I to inject alternate bursts of solvent and air into and through the flow path to clean the path and components therein of water and paint. After the valve I has been cycled on and off a number of times, it is maintained deactuated so that only air flows through and dries the path and components to electrically isolate the reservoir and charge of paint in it from ground potential. In consequence, and as will be described, paint in the reservoir can be then delivered to the spray device for being electrostatically charged without shorting out the high voltage at the spray device.

While the reservoir P is being charged with paint, the reservoir PP is delivering to the spray device a charge of paint previously loaded into it. At the end of delivery of paint from the reservoir PP, and prior to delivery of paint from the reservoir P, the high voltage is removed from the spray device and the ground leg OO is deenergized to ground the reservoir PP and its contents. Any significant volume of paint remaining in the reservoir PP and spray apparatus is then pushed out with air. To that end, and as shown in FIG. 2D, the valves H, JJ, KK, ZZ, FF, XX, D, YY and B1 are energized to establish a path for a flow of air from the check valve CV14 through the valves I, H, JJ, KK, the paint block NN and check valve CV7, into the upper end of the reservoir PP. The air exits the lower end of the reservoir and moves, along with paint pushed by it, through the valves ZZ, FF and XX, the regulator R1 and the spray device, with an override signal M being applied to the regulator control inlet to cause the regulator to exhibit minimum resistance to the flow of air and paint therethrough. From the spray device the air and paint move through the valves D and YY, check valve CV10, dump block RR and dump diverter valve B1 to the dump tank. The air does not thoroughly clean the flow path and components therein, but simply removes any major quantity of paint from the same.

After using air to push excess paint from the reservoir PP and spray apparatus, as shown in FIG. 2E the lines leading to the reservoir, as well as the paint supply and dump return lines leading to and from the spray apparatus, are flushed clean by actuating the valves J, H, JJ, BB, FF, XX, D, YY and B1 and by applying the override signal M at the fluid regulator control input to cause the regulator permit a free flow therethrough. Simultaneously, the valve I is alternately actuated and deactuated to cause alternate bursts of air and solvent to flow from the outlet of the valve through a path comprising the valves H and JJ, paint block NN, valves BB, FF and XX, fluid regulator R1, spray device, valves D and YY, check valve CV10, dump block RR and valve B1 to the dump tank. A sufficient number of alternate bursts of air and solvent are applied to flush the path clean, following which the valve I remains deactuated so that only air flows through and dries the path.

After the spray apparatus is cleaned of the color of paint previously delivered from the reservoir PP, the paint in the reservoir P is rapidly flowed to the spray apparatus. As seen in FIG. 2F, this is accomplished by actuating the valves H and K to introduce air from the valve I into the upper end of the reservoir P, while simultaneously energizing the valves Z, F, X, D, YY and B1, and applying the override signal M to the control input to the fluid pressure regulator R1, to flow paint from the lower end of the reservoir to the spray device. The valves H, K, D, YY and B1 are maintained energized for a time sufficient for paint to flow from the reservoir to the fluid inlet to the spray device, at which point those valves are deactuated and the override signal at the regulator control input is removed to interrupt the flow of paint.

With the paint delivery path from the reservoir P to the spray device filled with paint and the valves Z, F and X remaining actuated and open, as seen in FIG. 2G the paint in the reservoir is pressurized by opening the valve W to introduce air at a selected high pressure, for example 110 psi, into the upper end of the reservoir to push paint in the reservoir toward the spray device. Simultaneously, a preselected signal is applied at the control inlet to the fluid pressure regulator R1, such as the signal PRESSURE A, to cause paint to be supplied at a desired pressure to the spray device, the ground leg O is actuated to electrically isolate the reservoir and paint therein from ground, a high electrostatic charging voltage is applied to the spray apparatus and a valve in the spray device is opened for emission of paint from the device in an atomized spray. By virtue of the paint block N and dump block R having previously been cleaned, although the high voltage at the spray device will be coupled through a conductive column of paint to the paint in the reservoir P, it will be electrically isolated or blocked from the color changer assembly and its associated supplies of paint, as well as from the various components of the isolation system located between the color changer assembly and the paint and dump blocks.

While the spray apparatus is spraying paint delivered from the reservoir P, the color changer assembly, along with the LINE ONE of the isolation system, are flushed clean of paint by energizing the valves U, Q, T and G in the manner shown in FIG. 2H. The valve G is opened to establish a path through the LINE ONE and check valve CV2 to the dump tank, while the color changer air valve U and water valve Q are alternately opened to introduce alternate bursts of air and water through the color changer assembly and the LINE ONE. The flow meter bypass valve T is actuated when the air valve U is actuated and deactuated when the water valve Q is actuated, so only water passes through the flow meter S1, as passing air through it could cause its sensing elements to be overdriven and damaged.

While the color changer assembly and LINE ONE are being cleaned and paint delivered from the reservoir P is being sprayed, the reservoir PP and its paint supply and dump return lines are cleaned. To that end, and as shown in FIG. 21, the valves H, JJ, KK, ZZ, EE and B1 are first energized for a flow of air through a path that includes the check valve CV14, paint block NN, check valve CV7, reservoir PP, dump block RR and dump tank. The valves I and J are then energized for a flow of solvent through the path, with a diffuser LL in the upper end of the reservoir PP uniformly distributing solvent downwardly across the inner reservoir walls. The valves BB and CC are then briefly energized and the valves KK and EE are deenergized, so that solvent flows upwardly into the reservoir. Next, the valve KK is again actuated and the valves BB and CC are deactuated, whereupon solvent again flows into the upper end of and downwardly through the reservoir, after which the valve I is sequentially deenergized, energized and deenergized, so that a burst of air followed by a burst of solvent flows through the reservoir, followed by a flow of air.

After being cleaned of the color of paint it previously delivered to the spray apparatus, as seen in FIG. 2J the reservoir PP is then filled with the next color of paint to be delivered, for example color 2. To flow color 2 into the reservoir PP, the color changer inlet valve for color 2 is opened, as are the valves A, JJ, BB, ZZ, CC and B1. Paint of color 2 then flows into and charges the reservoir PP in a manner similar to charging of the reservoir P (FIG. 2A), until the flow meter S1 senses that a preselected volume of paint has passed through it, at which point the color changer inlet valve for color 2 is closed.

When the color changer inlet valve for color 2 is closed, a column of paint extends between the color changer outlet and the lower end of the reservoir PP. To move the column of paint into the reservoir, as shown in FIG. 2K the color changer valve Q is actuated, so that water then pushes the column of paint to and into the reservoir. The water push occurs in a manner similar to that which occurred during charging of the reservoir P (FIG. 2B), with the flow meter S2 measuring the volume flow of water through it. When a predetermined volume flow of water is measured, the valves A, BB, ZZ, CC, B1 and Q are deenergized. At this point, substantially the entirety of the column of paint has been pushed into the reservoir PP and a column of water extends between the color changer and a point close to but not at the lower end of the reservoir, such as to about the valve ZZ.

After the reservoir PP is charged with paint of color 2, the reservoir paint and dump blocks NN and RR, along with their associated fluid lines and valves, are flushed with solvent and dried to electrically isolate the reservoir from the color changer assembly. This is accomplished, as shown in FIG. 2L, by actuating the valves J, H, JJ, BB, EE and B1, while alternately actuating and deactuating the valve I, to inject alternate bursts of solvent and air through the paint and dump blocks and their associated lines and valves to clean the same. The air purge valve A2 also is briefly energized to clear any fluid trapped in the vent valve CC. After several energizations and deenergizations of the valve I, the valve is maintained deenergized and air flows through and dries the components. The flushing cycle occurs in a manner similar to that described in respect of flushing the paint and dump blocks N and R for the reservoir P (FIG. 2C).

Upon completion of delivery of paint from the reservoir P to the spray apparatus, the ground leg O is deactuated to ground the reservoir and its contents, and any excess paint remaining in the reservoir, in the delivery line from the reservoir to the spray device and in the spray device is rapidly pushed out with air. This is acomplished, as seen in FIG. 2M, by energizing the valves H, K, Z, F, X, D, Y and B2 and by applying the override signal M to the pressure regulator control input. The air push occurs in a manner similar to that described in respect of the reservoir PP (FIG. 2D).

After excess paint is removed from the reservoir P and spray apparatus, the lines to the reservoir, along with the paint and dump return lines from the spray apparatus, are flushed by operating the valves J, I, H, B, F, X, D, Y and B2, and by applying the override signal M to the pressure regulator control input, as shown in FIG. 2N. The operation proceeds in a manner similar to that described in respect of the reservoir PP (FIG. 2E), and cleans the spray apparatus of the color of paint previously delivered to it from the reservoir P.

The next color of paint to be sprayed, i.e., color 2 in the reservoir PP, is then rapidly delivered to the fluid inlet to the spray device by operating the valves H, JJ, KK, ZZ, FF, XX, D, Y and B2, and by applying the override signal M to the pressure regulator control input, as shown in FIG. 20. The operation occurs in a manner similar to that described in connection with the reservoir P (FIG. 2F).

Spraying of paint from the reservoir PP then occurs, as shown in FIG. 2P, by actuating the valves ZZ, FF and XX, by opening the valve WW to pressurize the reservoir to about 110 psi, and by selecting an appropriate paint pressure signal, e.g., PAINT PRESSURE A, for application to the control input to the pressure regulator R1. Also, the ground leg OO is actuated to isolate the reservoir and paint therein from ground potential, a high charging voltage is applied to the spray apparatus and the spray gun is actuated to emit an atomized spray of paint. The operation occurs in a manner similar to that described in connection with FIG. 2G.

While the spray device emits paint delivered from the reservoir PP, the color change assembly, LINE ONE, reservoir P and lines associated with the reservoir are cleaned. This occurs by actuating the valves U, Q, T, G, I, J, H, B, K, Z, C, E and B2, as shown in FIG. 2Q. The flush cycle proceeds in a manner similar to that described in connection with FIGS. 2H and 2I.

Following the flush cycle of FIG. 2Q, the reservoir P may be charged with the next selected color of paint, in the manner indicated in FIG. 2A. The sequence of FIGS. 2A–2Q is then repeated for successive colors of paint.

Although the color changer assembly, isolation system and spray apparatus may be manually operated, their operations are most easily and conveniently performed automatically, such as by computer control. Also, while the operations of FIGS. 2A–2Q have been described as being performed sequentially, they may be performed in other orders, or individually, to accomplish selected functions. For example, to electrically isolate a reservoir by means of a solvent flush, such as the reservoir P, only the operations of FIG. 2C need be performed, while to isolate the reservoir PP only the operations in FIG. 2L are performed. To simply purge a reservoir and the associated fluid lines to the spray apparatus, for the reservoir P the operations in FIG. 3A would be performed, and for the reservoir PP the operations in FIG. 3B. To purge a reservoir with solvent, the reservoir P would be flushed by performing the operations in FIG. 2Q, and the reservoir PP by the operations in FIG. 2I. If it is desired to just clean the color changer assembly with water, the operations in FIG. 2H are performed.

The described operation of the isolation system has been for the situation where the color changer assembly supplies successive different colors of paint alternately to the reservoirs P and PP. It often happens, however, that a plurality of successive articles are to be coated with the same color of paint. When that situation arises, the two reservoirs are alternately charged with paint of the same color for delivery to the spray device. Because only one color of paint is used, economies may be realized in the steps involved in operation of the isolation system, and the amount of paint "lost" incident to operation of the system may be minimized.

In operation of the isolation system in successively delivering metered quantities of the same color of paint to the spray apparatus, and starting with an initially empty system, as a first step the selected color of paint, for example color 1, is loaded into the reservoir P. As seen in FIG. 4A, this is accomplished by admitting paint of color 1 into the color changer, while simultaneously actuating the valves A, B, Z, C and B2 to establish a flow path for paint from the color changer to and into the lower end of the reservoir P and a vent path for air out of the upper end of the reservoir. The volume flow of paint is metered by the flow meter S1, and when it equals a predetermined volume the color changer valve for color 1 and the valve A are closed. When this occurs, a column of paint of known volume extends between the valve A and the lower end of the reservoir P, and comprises a portion of the total charge to be loaded into the reservoir. The paint column is therefore pushed by water away from the valve A and into the reservoir by actuating the valves I and H. The flow meter S2 measures the volume flow of water, and when a selected volume flow has been measured, all of the valves are deactuated. The selected volume flow is chosen so that a column of water then extends from the valve H to a point close to but not quite at the lower end of the reservoir P, for example to the valve Z.

Because of the column of water and a limited amount of paint residue extending between the color changer and reservoir P, an electrically conductive path exists between the reservoir and color changer. Therefore, to electrically isolate the reservoir from all of the color changer, paint supplies, grounded plate and components of the isolation system on the color changer side of the grounded plate, the column of water and paint residue are flushed from between the valve H and reservoir P. The flushing operation occurs in the manner described in respect of FIG. 2C.

With the reservoir P loaded with paint and electrically isolated from the color changer assembly, the paint in the reservoir is rapidly flowed to the spray apparatus by performing the operations described in connection with FIG. 2F. Spraying of paint delivered from the reservoir then occurs in the manner described in connection with FIG. 2G.

While paint from the reservoir P is being delivered to and emitted by the spray device, the reservoir PP is filled with paint of the same color 1. This is accomplished, as seen in FIG. 4B, by flowing paint of color 1 from the color changer assembly and through the valve A to the reservoir PP, and by then using water to push the column of paint, extending between the valve A and the reservoir, to and into the reservoir. After the reservoir PP is charged with paint, it is electrically isolated from the color changer assembly by performing the operations of FIG. 2L.

Upon completion of delivery of paint from the reservoir P to the spray apparatus, as seen in FIG. 4C the reservoir is depressurized by closing the air pressure valve W and grounded by deactuating the ground leg O, the high voltage is removed from the spray device, and the valves Z, F and X are closed. At this point, a column of paint of color 1 delivered from the reservoir P extends between a manifold, i.e., a juncture between the valves X and XX, and the fluid inlet to the spray device. Paint of color 1 is then rapidly flowed from the reservoir PP to the manifold, as seen in FIG. 4D, by actuating the valves H, JJ and KK to pressurize the reservoir PP, by actuating the valves ZZ, FF and XX to establish a flow path for paint from the reservoir to the manifold, and by actuating the valves DD, Y and B2 to establish a vent path for air.

Prior to delivery of paint from the reservoir PP to the spray device for emission in an electrostatically charged atomized spray, the reservoir P is isolated from the manifold and spray device. This is accomplished, as seen in FIG. 4E, by actuating the valves J, H, B, F, X, DD, Y and B2, and by alternately actuating and deactuating the valve I a number of times, to introduce alternate bursts of solvent and air through a path including the paint block N, the valves B, F, X, DD and Y, the dump block R and the valve B2, with the solvent and air exiting the valve B2 being directed to the dump tank. After the valve I has been cycled several times, it and the valve J are deactuated and only air flows through and dries the path to isolate the reservoir P from the manifold and spray apparatus.

After the reservoir P is electrically isolated from the manifold and spray apparatus, paint is flowed from the reservoir PP to the spray apparatus for being emitted in an atomized spray, as described in connection with FIG. 2P. While paint from the reservoir PP is being sprayed, the reservoir P is reloaded, according to FIG. 4A, with paint of the same color 1, and is then electrically isolated from the color changer in the manner illustrated in FIG. 2C.

Upon completion of spraying of paint delivered from the reservoir PP, the reservoir is depressurized and grounded, the high voltage is removed from the spray device and the valves ZZ, FF and XX in the flow path between the reservoir and spray device are closed, as seen in FIG. 4F. Paint in the reservoir P is then rapidly flowed to the manifold, as seen in FIG. 4G, following which the reservoir PP is electrically isolated from the manifold. Electrical isolation of the reservoir PP from the manifold is accomplished, as seen in FIG. 4H, by actuating the valves J, H, JJ, BB, FF, XX, DD, YY and B1, while alternately actuating and deactuating the valve I, to introduce alternate bursts of air and solvent through a path including the valves BB, FF, XX, DD, YY and B1. After the valve I has been cycled a number of times, it and the valve J are deactuated and only air flows through and dries the path to electrically isolate the reservoir PP from the manifold. Spraying of paint delivered from the reservoir P may then take place, as shown in FIG. 2G.

For as long as it is desired to continue spraying paint of color 1, metered volumes of the paint may be delivered to the spray device, from the reservoirs P and PP, by the sequential and cyclical performance of the operations illustrated in FIGS. 2G, 4B, 2L, 4C, 4D, 4E, 2P, 4A, 2C, 4F, 4G and 4H.

After a period of time, it is possible that an accumulation of paint residue may occur within the color changer, that cannot readily be cleaned by a water flush. The solvent inlet GG to the color changer is therefore provided for use in thoroughly cleaning the color changer, according to the steps in FIG. 5. In essence, the valve G is opened while the color changer air and solvent valves U and GG are alternately actuated to introduce alternate bursts of air and solvent through the color changer and valve G to the dump tank. Whenever the air valve U is actuated, the flow meter bypass valve T also is actuated to prevent air from flowing through and possibly damaging the flow meter S1.

The invention therefore provides a novel isolation system for use in color changing conductive coating materials that are applied with electrostatic spraying equipment. Since the reservoirs are charged with a metered volume of paint, and with only as much paint as is necessary to spray a specific job, during spraying only a limited quantity of paint is charged to the high electrostatic voltage, and since the color changer and its supplies of paint are at all times maintained at ground potential, the hazard of a high capacitance discharge is greatly reduced. The system therefore provides an effective, safe and economical manner in which to apply conductive materials electrostatically.

The system as described utilizes two reservoirs. Once one is charged with paint, it is electrically isolated from the grounded color changer and paint supplies. For safety, associated with each reservoir is a ground leg for selectively grounding the reservoir and its contents. Except for when the reservoir is delivering paint to the spray apparatus and a high charging voltage is at the apparatus, the ground leg connects the reservoir to circuit ground. Only while the spray apparatus is spraying and electrostatically charging paint delivered from a reservoir is the reservoir isolated from ground.

To shorten the time between color changes, while one reservoir delivers paint to the spray apparatus, the other is being flushed, filled with paint of the next color to be sprayed and isolated from the grounded color changer and paint supplies. This simultaneous action provides the system with the ability to react to short purge and fill requirements. Advantageously, in the event of an electrostatic power supply overload, the ground legs connect both reservoirs to ground potential to eliminate the chance of a high capacitance discharge.

While embodiments of the invention have been described in detail, various modifications and other embodiments thereof may be devised by one skilled in the art without departing from the spirit and scope of the invention, as defined in the appended claims.

What is claimed is:

1. A system for supplying selected electrically conductive coating materials to high voltage electrostatic coating apparatus, comprising a color changer having inlets for connection with respective ones of a plurality of supplies of the coating materials and an outlet for the materials; a reservoir connectable to the coating apparatus; coupling means connecting said color changer outlet to said reservoir; means for operating said color changer to flow coating material from a selected one of the supplies from said color outlet into and through said coupling means to and into said reservoir; means, operative after said color changer flows coating material into said reservoir, for flowing a solvent for the coating material into said coupling means at said color changer outlet to push coating material remaining in said coupling means to and into said reservoir; means, operative after coating material remaining in said coupling means has been pushed by the solvent to and into said reservoir, for flushing at least a portion of said coupling means between said color changer outlet and said reservoir to electrically isolate coating material in said reservoir from said color changer and the supplies of coating material; and means, operative after coating material in said reservoir has been electrically isolated from said color changer and the supplies, for delivering coating material in said reservoir to the coating apparatus for being electrostatically charged and emitted by the coating apparatus, whereby the high voltage at the coating apparatus is electrically isolated from said color changer and from the supplies of coating material.

2. A system as in claim 1, wherein said color changer and the supplies of coating material are electrically grounded.

3. A system as in claim 1, wherein said coupling means includes a manifold of electrically insulating material that has a passage therethrough in-line between said color changer outlet and said reservoir, and said flushing means flushes said manifold passage to electrically isolate coating material in said reservoir from said color changer and the coating material supplies.

4. A system as in claim 1, including means for connecting the contents of said reservoir to ground potential whenever coating material in said reservoir is not being delivered to and electrostatically charged by the coating apparatus, and for disconnecting the contents from ground potential whenever coating material in said reservoir is being delivered to and electrostatically charged by the coating apparatus.

5. A system as in claim 1, including means for measuring the volume of coating material flowed from said color changer outlet and for controlling said color changer operating means to interrupt the flow when a preselected volume has been measured, whereby said preselected volume of coating material is supplied to said reservoir.

6. A system for supplying selected electrically conductive coating materials to high voltage electrostatic coating apparatus, comprising a color changer having inlets for connection with respective ones of a plurality of supplies of the coating materials and an outlet for the materials; a reservoir connectable to the coating apapratus; coupling means connecting said color changer outlet to said reservoir; means for operating said color changer to flow coating material from a selected one of the supplies from said color changer outlet into and through said coupling means to and into said reservoir; means for flushing a portion of said coupling means between said color changer outlet and said reservoir, after flow of coating material from said color changer outlet through said coupling means to said reservoir, to electrically isolate coating material in said reservoir from said color changer and the supplies of coating material; means, operative after coating material in said reservoir has been electrically isolated from said color changer and the supplies, for delivering coating material in said reservoir to the coating apparatus for being electrostatically charged and emitted by the coating apparatus, whereby the high voltage at the coating apparatus is electrically isolated from said color changer and from the supplies of coating material; and means operable to connect the contents of said reservoir to ground potential whenever coating material in said reservoir is not being delivered to and electrostatically charged by the coating apparatus and to disconnect the contents from ground potential whenever coating material in said reservoir is being delivered to and electrostatically charged by the coating apparatus.

7. A system as in claim 6, including means, operative after said color changer flows coating material into and through said coupling means and prior to flushing at least a portion of said coupling means, for flowing a solvent for the coating material into said coupling means at said color changer outlet to push coating material remaining in said coupling means to and into said reservoir.

8. A system as in claim 7, wherein said coupling means has a known volumetric capacity and said means for flowing solvent flows into said coupling means a volume of solvent substantially equal to said known volumetric capacity.

9. A system for supplying selected electrically conductive coating materials to high voltage electrostatic coating apparatus, comprising a color changer having inlets for connection with respective ones of a plurality of supplies of the coating materials and an outlet for the materials; a reservoir connectable to the coating apparatus; coupling means connecting said color changer outlet to said reservoir; means for operating said color changer to flow coating material from a selected one of the supplies from said color changer outlet into and through said coupling means to and into said reservoir; means for measuring the volume flow of coating material from said color changer outlet and for causing said color changer operating means to interrupt the flow when a preselected volume flow has been measured; means for flushing at least a portion of said coupling means between said color changer outlet and said reservoir, after coating material has been flowed through said coupling means to said reservoir, to electrically isolate coating material in said reservoir from said color changer and the supplies of coating material; and means, operative after coating material in said reservoir has been electrically isolated from said color changer and the supplies, for delivering coating material in said reservoir to the coating apparatus for being electrostatically charged and emitted by the coating apparatus, whereby the high voltage at the coating apparatus is electrically isolated from said color changer and the supplies of coating material, wherein said coupling means has a known volumetric capacity and including means, operative after said color changer flows coating material into and through said coupling means and prior to flushing at least a portion of said coupling means, for flowing into said coupling means at said color changer outlet a volume of solvent substantially equal to said known volumetric capacity to push coating material remaining in said coupling means to and into said reservoir.

10. A system for supplying selected electrically conductive coating materials to high voltage electrostatic coating apparatus, comprising a color changer having inlets for connection with respective ones of a plurality of supplies of the coating materials and an outlet for the materials; a reservoir connectable to the coating apparatus; coupling means connecting said color changer outlet to said reservoir; means for operating said color changer to flow coating material from a selected one of the supplies from said color changer outlet into and through said coupling means to and into said reservoir; means for measuring the volume flow of coating material from said color changer outlet and for causing said color changer operating means to interrupt the flow when a preselected volume flow has been measured; means for flushing at least a portion of said coupling means between said color changer outlet and said reservoir, after coating material has been flowed through said coupling means to said reservoir, to electrically isolate coating material in said reservoir from said color changer and the supplies of coating material; and means, operative after coating material in said reservoir has been electrically isolated from said color changer and the supplies, for delivering coating material in said reservoir to the coating apparatus for being electrostatically charged and emitted by the coating apparatus, whereby the high voltage at the coating apparatus is electrically isolated from said color changer and the supplies of coating material, and including means for electrically grounding the contents of said reservoir whenever coating material in said reservoir is not being delivered to and electrostatically charged by the coating apparatus and for ungrounding the contents whenever coating material in said reservoir is being delivered to and electrostatically charged by the coating apparatus.

11. A system for supplying selected electrically conductive coating materials to high voltage electrostatic coating apparatus, comprising a color changer having inlets for connection with respective ones of a plurality of supplies of the coating materials and an outlet for the materials; a reservoir connectable to the coating apparatus; coupling means defining a supply path connecting said color changer outlet to said reservoir and a return path connecting said reservoir to a dump tank; means for operating said color changer to flow coating material from a selected one of the supplies from said color changer outlet into and through said coupling means supply path to and into said reservoir; means for flushing at least a portion of said coupling means supply path and at least a portion of said coupling means return path, after flowing coating through said supply path and into said reservoir, to electrically isolate coating material in said reservoir from said color changer, the supplies of coating material and the dump tank; and means, operative after coating material in said reservoir has been electrically isolated from said color changer, the coating material supplies and the dump tank, for delivering coating material in said reservoir to the coating apparatus for electrostatic charging and emission of the coating material by the coating apparatus, whereby the high voltage at the coating apparatus is electrically isolated from said color changer, the supplies of coating material and the dump tank, and including means operable to ground the contents of said reservoir whenever coating material in said reservoir is not being delivered to and electrostatically charged by the coating apparatus and to unground the contents whenever coating material in said reservoir is being delivered to and electrically charged by the coating apparatus.

12. A system for supplying selected electrically conductive coating materials to high voltage electrostatic coating apparatus, comprising a color changer having inlets for connection with respective ones of a plurality of supplies of the coating materials and an outlet for the materials; a pair of reservoirs each connectable to the coating apparatus; coupling means for selectively connecting said color changer outlet to one or the other of said reservoirs; means for operating said color changer and coupling means to flow coating materials from selected ones of the supplies from said color changer outlet into and through said coupling means alternately to and into one and then the other of said reservoirs; means for flushing at least a portion of said coupling means between said color changer outlet and whichever reservoir has just been filled with coating material to electrically isolate coating material in such reservoir from said color changer and the supplies of coating material; means for alternately delivering coating material from one reservoir and then from the other to the coating apparatus for electrostatic charging and emission of the coating material by the coating apparatus, such that coating material in the reservoir that has just been filled and electrically isolated from the color changer and supplies is delivered to the coating apparatus while the other reservoir is being filled with coating material and the coating material then electrically isolated from the color changer and supplies; and means, responsive upon completion of delivery of coating material from one reservoir to the coating apparatus and prior to delivery of coating material from the other reservoir, for flushing the connection between the coating apparatus and the one reservoir to electrically isolate the contents of the one reservoir from the coating apparatus, whereby the high voltage at the coating apparatus is maintained electrically isolated from said color changer is maintained electrically isolated from said color changer and the supplies of coating material, and including a pair of ground legs, each coupled to an associated one of the reservoirs for connecting the contents of its associated reservoir to ground potential whenever coating material in the reservoir is not being delivered to and electrostatically charged by the coating apparatus and for disconnecting the contents of the reservoir from ground potential whenever coating material in the reservoir is being delivered to and electrostatically charged by the coating apparatus.

13. A method of supplying selected electrically conductive coating materials to high voltage electrostatic coating apparatus with a color changer having inlets for connection with respective ones of a plurality of supplies of the coating materials and an outlet for the materials, while maintaining electrical isolation between the high voltage at the coating apparatus and the color changer and supplies of coating materials, said method comprising the steps of coupling the color changer outlet to a reservoir through a supply path; connecting the reservoir to the coating apparatus through a delivery path; operating the color changer to flow coating material from a selected one of the supplies from the color changer outlet into and through the supply path to and into the reservoir; after completion of said operating step, introducing a solvent for the coating material into the supply path at the color changer outlet to push coating material remaining in the supply path to and into the reservoir; after completion of said introducing step, flushing at least a portion of the supply path between the color changer outlet and reservoir to electrically isolate coating material in the reservoir from the color changer and supplies of coating materials; and, after completion of said flushing step, delivering coating material in the reservoir through the delivery path to the coating apparatus for being electrostatically charged and emitted by the coating apparatus, whereby the high voltage at the coating apparatus is electrically isolated from the color changer and supplies of coating materials.

14. A method as in claim 13, including the step of maintaining the color changer and supplies of coating materials at ground potential.

15. A method as in claim 13, wherein said coupling step couples the color changer outlet to the reservoir through a supply path that includes a passage through a manifold of electrically insulating material, and said flushing step flushes the manifold passage.

16. A method as in claim 13, including the steps of connecting the contents of the reservoir to ground potential whenever coating material in the reservoir is not being delivered to and electrostatically charged by the coating apparatus, and disconnecting the contents of the reservoir from ground potential whenever coating material in the reservoir is being delivered to and electrostatically charged by the coating apparatus.

17. A method as in claim 13, including the steps of measuring the volume of coating material flowed from the color changer outlet during performance of said operating step, and interrupting performance of said operating step upon measuring a preselected volume of coating material flow.

18. A method as in claim 13, wherein the supply path has a known volumetric capacity, and including the steps of measuring the volume of solvent flowed into the supply path during performance of said introducing step, and interrupting performance of said introducing step when the measured volume flow is substantially equal to the known volumetric capacity.

19. A method as in claim 13, including the steps, following completion of said delivery step, of removing the high voltage from the coating apparatus and flushing the reservoir, the supply path and the delivery path to clean the same in preparation for supplying the next selected coating material to the coating apparatus, and then repeating the foregoing steps for each successive selected coating material supplied to the coating apparatus.

20. A method of supplying selected electrically conductive coating materials to high voltage electrostatic coating apparatus with a color changer having inlets for connection with respective ones of a plurality of supplies of the coating materials and an outlet for the materials, while maintaining electrical isolation between the high voltage at the coating apparatus and the color changer and supplies of coating materials, said method comprising the steps of coupling the color changer outlet to a reservoir through a supply path; connecting the reservoir to the coating apparatus through a delivery path; operating the color changer to flow coating material from a selected one of the supplies from the color changer outlet into and through the supply path to and into the reservoir; after completion of said operating step, flushing at least a portion of the supply path between the color changer outlet and reservoir to electrically isolate coating material in the reservoir from the color changer and supplies of coating materials; after completion of said flushing step, delivering coating material in the reservoir through the delivery path to the coating apparatus for being electrostatically charged and emitted by the coating apparatus, whereby the high voltage at the coating apparatus is electrically isolated from the color changer and supplies of coating materials; and selectively connecting the contents of the reservoir to ground potential whenever coating material in the reservoir is not being delivered to and electrostatically charged by the coating apparatus and disconnecting the contents from ground potential whenever coating material in the reservoir is being delivered to and electrostatically charged by the coating apparatus.

21. A method as in claim 20, including the step, after said operating step and prior to said flushing step, of introducing a solvent for the coating material into the supply path at the color changer outlet to push coating material remaining in the supply path to and into the reservoir.

22. A method as in claim 21, wherein the supply path has a known volumetric capacity, and including the steps of measuring the volume flow of coating material from the color changer outlet into the supply path during performance of said operating step and interrupting performance of said operating step in response to the measured volume flow of coating material equaling a selected volume, and measuring the volume flow of solvent into the supply path during performance of said introducing step and interrupting performance of said introducing step upon the measured volume flow of solvent being substantially equal to the known volumetric capacity.

23. A method of supplying selected electrically conductive coating materials to high voltage electrostatic coating apparatus with a color changer having inlets for connection with respective ones of a plurality of supplies of the coating materials and an outlet for the materials, while maintaining electrical isolation between the high voltage at the coating apparatus and the color changer and supplies of coating materials, said method comprising the steps of coupling the color changer outlet to a reservoir through a supply path; connecting the reservoir to the coating apparatus through a delivery path; operating the color changer to flow coating material from a selected one of the supplies from the color changer outlet into and through the supply path to and into the reservoir; measuring the volume flow of coating material from the color changer outlet during performance of said operating step and interrupting performance of said operating step upon the measured volume flow equaling a predetermined volume; after completion of said operating step, introducing a solvent for the coating material into the supply path at the color changer outlet to push coating material remaining in the supply path to and into the reservoir; measuring the volume flow of solvent into the supply path in response to performance of said introducing step and interrupting performance of said introducing step when the volume flow is substantially equal to a known volumetric capacity of the supply path; after completion of said introducing step, flushing at least a portion of the supply path between the color changer outlet and reservoir to electrically isolate coating material in the reservoir from the color changer and supplies of coating materials; and, after completion of said flushing step, delivering coating material in the reservoir through the delivery path to the coating apparatus for being electrostatically charged and emitted by the coating apparatus, whereby the high voltage at the coating apparatus is electrically isolated from the color changer and supplies of coating materials.

24. A method as in claim 23, including the step of selectively ground the contents of the reservoir, such that the contents are grounded whenever coating material in the reservoir is not being delivered to and electrostatically charged by the coating apparatus and are ungrounded whenever coating material is being delivered to and electrostatically charged by the coating apparatus.

25. A method as in claim 23, wherein the supply path includes a passage through a manifold of electrically insulating material, and said step of flushing at least a portion of the supply path comprises flushing the passage through the manifold.

26. A method of supplying selected electrically conductive coating materials to high voltage electrostatic coating apparatus with a color changer having inlets for connection with respective ones of a plurality of supplies of the coating materials and an outlet for the materials, while maintaining electrical isolation between the high voltage at the coating apparatus and the color changer and supplies of coating materials, said method comprising the steps of coupling the color changer outlet to a reservoir through a supply path; coupling the reservoir to a dump tank through a dump return path; connecting the reservoir to the coating apparatus through a delivery path; operating the color changer to flow coating material from a selected one of the supplies from the color changer outlet into and through the supply path to and into the reservoir; after completion of said operating step, flushing at least a portion of the supply path between the color changer outlet and reservoir and at least a portion of the dump return path between the reservoir and dump tank to electrically isolate coating material in the reservoir from the color changer, coating material supplies and dump tank; and, after completion of said introducing step, delivering coating material in the reservoir through the delivery path to the coating apparatus for being electrostatically charged and emitted by the coating apparatus, whereby the high voltage at the coating apparatus is electrically isolated from the color changer, coating material supplies and dump tank, and including the step of selectively grounding the contents of the reservoir, such that the contents are grounded whenever coating material in the reservoir is not being delivered to and electrostatically charged by the coating apparatus and are ungrounded whenever coating material in the reservoir is being delivered to and electrostatically charged by the coating apparatus.

27. A method of supplying selected electrically conductive coating materials to high voltage electrostatic coating apparatus with a color changer having inlets for connection with respective ones of a plurality of supplies of the coating materials and an outlet for the materials, while maintaining electrical isolation between the high voltage at the coating apparatus and the color changer and supplies of coating materials, said method comprising the steps of coupling the color changer outlet to a reservoir through a supply path; coupling the reservoir to a dump tank through a dump return path; connecting the reservoir to the coating apparatus through a delivery path; operating the color changer to flow coating material from a selected one of the supplies from the color changer outlet into and through the supply path to and into the reservoir; after completion of said operating step, flushing at least a portion of the supply path between the color changer outlet and reservoir and at least a portion of the dump return path between the reservoir and dump tank to electrically isolate coating material in the reservoir from the color changer, coating material supplies and dump tank; and, after completion of said introducing step, delivering coating material in the reservoir through the delivery path to the coating apparatus for being electrostatically charged and emitted by the coating apparatus, whereby the high voltage at the coating apparatus is electrically isolated from the color changer, coating material supplies and dump tank, and including the step, after said operating step and before said flushing step, of flowing a solvent for the coating material into the supply path at the color changer outlet to push coating material remaining in the supply path to and into the reservoir.

28. A method as in claim 27, wherein the supply path has a known volumetric capacity, and including the steps of measuring the volume flow of coating material into the supply path from the color changer outlet in response to performance of said operating step and interrupting performance of said operating step when a selected volume flow of coating material has been measured, and measuring the volume flow of solvent into the supply path in response to performance of said flowing step and interrupting performance of said flowing step when the measured volume flow of solvent substantially equals the known volumetric capacity.

29. A method of supplying selected electrically conductive coating materials to high voltage electrostatic coating apparatus with a color changer having inlets for connection with respective ones of a plurality of supplies of the coating materials and an outlet for the materials, while maintaining electrical isolation between the high voltage at the coating apparatus and the color changer and supplies of coating materials, said method comprising the steps of coupling the color changer outlet to first and second reservoirs through respective first and second supply paths; connecting the first and second reservoirs to the coating apparatus through respective first and second delivery paths; flowing coating materials from selected ones of the coating material supplies from the color changer outlet alternately to and into the first and second reservoirs through the respective first and second supply paths; after filling a reservoir with coating material, electrically isolating coating material in it from the color changer and coating material supplies by flushing at least a portion of its respective supply path; while filling one reservoir with coating material and then electrically isolating coating material in it from the color changer and coating material supplies, delivering coating material from the other reservoir through its respective delivery path to the coating apparatus for being electrostatically charged and emitted by the coating apparatus; upon completion of delivery of coating material from a reservoir to the coating apparatus, electrically isolating the contents in it from the coating apparatus by flushing at least a portion of its respective delivery path; upon electrical isolation of the contents of one reservoir from the coating apparatus, delivering coating material from the other reservoir through its respective delivery path to the coating apparatus for being electrostatically charged and emitted by the coating apparatus; upon completion of electrical isolation of the contents of one reservoir from the coating apparatus and while delivering coating material in the other reservoir to the coating apparatus, cleaning the one reservoir of coating material remaining in it before flowing the next selected coating material into it; and repeating the foregoing steps, and including the step of selectively electrically grounding the contents of the first and second reservoirs whenever coating material in the particular reservoir is not being delivered to and electrostatically charged by the coating apparatus.

30. A method of supplying selected electrically conductive coating materials to high voltage electrostatic coating apparatus with a color changer having inlets for connection with respective ones of a plurality of supplies of the coating materials and an outlet for the materials, while maintaining electrical isolation between the high voltage at the coating apparatus and the color changer and supplies of coating materials, said method comprising the steps of coupling the color changer outlet to first and second reservoirs through respective first and second supply paths; connecting the first and second reservoirs to the coating apparatus through respective first and second delivery paths; flowing coating materials from selected ones of the coating material supplies from the color changer outlet alternately to and into the first and second reservoirs through the respective first and second supply paths; after filling a reservoir with coating material, electrically isolating coating material in it from the color changer and coating material supplies by flushing at least a portion of its respective supply path; while filling one reservoir with coating material and then electrically isolating coating material in it from the color changer and coating material supplies, delivering coating material from the other reservoir through its respective delivery path to the coating apparatus for being electrostatically charged and emitted by the coating apparatus; upon completion of delivery of coating material from a reservoir to the coating apparatus, electrically isolating the contents in it from the coating apparatus by flushing at least a portion of its respective delivery path; upon electrical isolation of the contents of one reservoir from the coating apparatus, delivering coating material from the other reservoir through its respective delivery path to the coating apparatus for being electrostatically charged and emitted by the coating apparatus; upon completion of electrical isolation of the contents of one reservoir from the coating apparatus and while delivering coating material in the other reservoir to the coating apparatus, cleaning the one reservoir of coating material remaining in it before flowing the next selected coating material into it; and repeating the foregoing steps, and including the step, following said step of flowing coating material to one of the reservoirs through its associated supply path, of introducing a solvent for the coating materials into the associated supply path to push coating material remaining in the supply path to and into the reservoir.

31. A method as in claim 30, including the step of controlling said flowing step to flow preselected volumes of coating materials alternately to the first and second reservoirs.

32. A method as in claim 31, wherein the first and second supply paths have known volumetric capacities, and including the steps of measuring the volume flows of solvent introduced into the first and second supply paths, and controlling said solvent introducing step to introduce into each of the first and second supply paths a volume of solvent substantially equal to the known volumetric capacity of the supply path.

33. A method of supplying selected electrically conductive coating materials to high voltage electrostatic coating apparatus with a color changer having inlets for connection with respective ones of a plurality of supplies of coating materials and an outlet for the materials, while maintaining electrical isolation between the high voltage at the coating apparatus and the color changer and supplies of coating materials, wherein the color changer outlet is connected to first and second reservoirs through respective first and second supply paths and the first and second reservoirs are connected to the coating apparatus through respective first and second delivery paths, said method comprising the sequential steps of flowing coating material from a selected one of the supplies from the color changer outlet into and through the first supply path to and into the first reservoir; electrically isolating the first reservoir from the color changer and coating material supplies by flushing at least a portion of the first supply path; interrupting delivery of coating material, previously flowed into the second reservoir, from the second reservoir through the second delivery path to the coating apparatus; electrically isolating the contents of the second reservoir from the coating apparatus by flushing at least a portion of the second delivery path; delivering coating material in the first reservoir through the first delivery path to the coating apparatus for being electrostatically charged and emitted by the coating apparatus; cleaning the second reservoir of coating material previously delivered from it to the coating apparatus; flowing coating material from another selected one of the supplies from the color changer outlet through the second supply path to and into the second reservoir; electrically isolating the second reservoir from the color changer and coating material supplies by flushing at least a portion of the second supply path; interrupting delivery of coating material from the first reservoir through the first delivery path to the coating apparatus; electrically isolating the contents of the first reservoir from the coating apparatus by flushing at least a portion of the first delivery path; delivering coating material in the second reservoir through the second delivery path to the coating apparatus for being electrostatically charged and emitted by the coating apparatus; cleaning the first reservoir of coating material previously delivered from it to the coating apparatus; and repeating the above steps for each successive coating material to be delivered to the coating apparatus for being electrostatically charged and emitted thereby, and including the step of selectively grounding the contents of the first and second reservoirs whenever coating material in the particular reservoir is not being delivered to and electrostatically charged by the coating apparatus.

34. A method of supplying selected electrically conductive coating materials to high voltage electrostatic coating apparatus with a color changer having inlets for connection with respective ones of a plurality of supplies of coating materials and an outlet for the materials, while maintaining electrical isolation between the high voltage at the coating apparatus and the color changer and supplies of coating materials, wherein the color changer outlet is connected to first and second reservoirs through respective first and second supply paths and the first and second reservoirs are connected to the coating apparatus through respective first and second delivery paths, said method comprising the sequential steps of flowing coating material from a selected one of the supplies from the color changer outlet into and through the first supply path to and into the first reservoir; electrically isolating the first reservoir from the color changer and coating material supplies by flushing at least a portion of the first supply path; interrupting delivery of coating material, previously flowed into the second reservoir, from the second reservoir through the second delivery path to the coating apparatus; electrically isolating the contents of the second reservoir from the coating apparatus by flushing at least a portion of the second delivery path; delivering coating material in the first reservoir through the first delivery path to the coating apparatus for being electrostatically charged and emitted by the coating apparatus; cleaning the second reservoir of coating material previously delivered from it to the coating apparatus; flowing coating material from another selected one of the supplies from the color changer outlet through the second supply path to and into the second reservoir; electrically isolating the second reservoir from the color changer and coating material supplies by flushing at least a portion of the second supply path; interrupting delivery of coating material from the first reservoir through the first delivery path to the coating apparatus; electrically isolating the contents of the first reservoir from the coating apparatus by flushing at least a portion of the first delivery path; delivering coating material in the second reservoir through the second delivery path to the coating apparatus for being electrostatically charged and emitted by the coating apparatus; cleaning the first reservoir of coating material previously delivered from it to the coating apparatus; and repeating the above steps for each successive coating material to be delivered to the coating apparatus for being electrostatically charged and emitted thereby, and including the step, following each said step of flowing coating material from the color changer outlet to a reservoir through its associated supply path, of introducing a solvent for the coating material into the supply path at the color changer outlet to push coating material remaining in the supply path to and into the reservoir.

35. A method as in claim 34, including the steps of measuring the volume flow of coating material from the color changer outlet into a supply path during performance of said flowing step, and interrupting performance of said flowing step when the measured volume flow of coating material equals a preselected volume.

36. A method as in claim 35, wherein said first and second supply paths have known volumetric capacities, and including the steps of measuring the volume flow of solvent introduced into a supply path during performance of said introducing step, and interrupting performance of said introducing step when the measured volume flow of solvent is substantially equal to the known volumetric capacity of the particular supply path.

37. A method of sequentially supplying a selected electrically conductive coating material to high voltage electrostatic coating apparatus with a color changer having inlets for connection with respective ones of a plurality of supplies of coating materials and an outlet for the materials, while maintaining electrical isolation between the high voltage at the coating apparatus and the color changer and supplies of coating materials, wherein the color changer is coupled to first and second reservoirs through respective first and second supply paths and the first and second reservoirs are connected to the coating apparatus through respective first and second delivery paths, said method comprising the sequential steps of flowing coating material from a selected supply from the color changer outlet into and through the first supply path to and into the first reservoir; electrically isolating the first reservoir from the color changer and coating material supplies by flushing at least a portion of the first supply path; interrupting delivery of the selected coating material, previously flowed into the second reservoir, from the second reservoir through the second delivery path to the coating apparatus; electrically isolating coating material remaining in the second reservoir from the coating apparatus by flushing at least a portion of the second delivery path; delivering coating material in the first reservoir through the first delivery path to the coating apparatus for being electrostatically charged and emitted by the coating apparatus; flowing coating material from the selected supply from the color changer outlet into and through the second supply path to and into the second reservoir; isolating coating material in the second reservoir from the color changer and coating material supplies by flushing at least a portion of the second supply path; upon completion of delivery of coating material from the first reservoir to the coating apparatus, isolating coating material in the first reservoir from the coating apparatus by flushing at least a portion of the first delivery path; delivering coating material in the second reservoir through the second delivery path to the coating apparatus for being electrostatically charged and emitted by the coating apparatus; and repeating the foregoing steps for successive deliveries of the selected coating material to the coating apparatus, and including the step of selectively grounding the contents of the first and second reservoirs whenever coating material in the particular reservoir is not being delivered to and electrostatically charged by the coating apparatus.

38. A method of sequentially supplying a selected electrically conductive coating material to high voltage electrostatic coating apparatus with a color changer having inlets for connection with respective ones of a plurality of supplies of coating materials and an outlet for the materials, while maintaining electrical isolation between the high voltage at the coating apparatus and the color changer and supplies of coating materials, wherein the color changer is coupled to first and second reservoirs through respective first and second supply paths and the first and second reservoirs are connected to the coating apparatus through respective first and second delivery paths, said method comprising the sequential steps of flowing coating material from a selected supply from the color changer outlet into and through the first supply path to and into the first reservoir; electrically isolating the first reservoir from the color changer and coating material supplies by flushing at least a portion of the first supply path; interrupting delivery of the selected coating material, previously flowed into the second reservoir, from the second reservoir through the second delivery path to the coating apparatus; electrically isolating coating material remaining in the second reservoir from the coating apparatus by flushing at least a portion of the second delivery path; delivering coating material in the first reservoir through the first delivery path to the coating apparatus for being electrostatically charged and emitted by the coating apparatus; flowing coating material from the selected supply from the color changer outlet into and through the second supply path to and into the second reservoir; isolating coating material in the second reservoir from the color changer and coating material supplies by flushing at least a portion of the second supply path; upon completion of delivery of coating material from the first reservoir to the coating apparatus, isolating coating material in the first reservoir from the coating apparatus by flushing at least a portion of the first delivery path; delivering coating material in the second reservoir through the second delivery path to the coating apparatus for being electrostatically charged and emitted by the coating apparatus; and repeating the foregoing steps for successive deliveries of the selected coating material to the coating apparatus, and including the step, following each said step of flowing coating material from the color changer outlet to a reservoir through its associated supply path, of introducing a solvent for the coating material into the supply path at the color changer outlet to push coating material remaining in the supply path to and into the reservoir.

39. A method as in claim 38, including the steps of measuring the volume flow of coating material flowed from the color changer outlet into a supply path during each performance of said flowing step, and interrupting performance of said flowing step when the measured volume flow equals a preselected volume.

40. A method as in claim 39, wherein each of the first and second supply paths have known volumetric capacities, and including the steps of measuring the volume flow of solvent introduced into a supply path during performance of said introducing step, and interrupting performance of said introducing step when the measured volume flow of solvent is substantially equal to the known volumetric capacity of the paticular supply path.

41. A system for supplying electrically conductive coating material to high voltage electrostatic coating apparatus, comprising a coating material supply having an outlet for the material; a reservoir connectable to the coating apparatus; coupling means connecting said coating material supply outlet to said reservoir; means for operating said coating material supply to flow coating material from said coating material supply outlet into and through said coupling means to and into said reservoir; means, operative after said coating material supply flows coating material into said reservoir, for flowing a solvent for the coating material into said coupling means to push coating material remaining in said coupling means to and into said reservoir; means, operative after coating material remaining in said coupling means to and into said reservoir; means, operative after coating material remaining in said coupling means has been pushed by the solvent to and into said reservoir, for flushing at least a portion of said coupling means between said coating material supply outlet and said reservoir to electrically isolate coating material in said reservoir from said coating material supply; and means, operative after coating material in said reservoir has been electrically isolated from said coating material supply, for delivering coating material in said reservoir to the coating apparatus for being electrostatically charged and emitted by the coating apparatus, whereby the high voltage at the coating apparatus is electrically isolated from said coating material supply.

42. A system as in claim 41, wherein said coating material supply is electrically grounded.

43. A system as in claim 41, wherein said coupling means includes a manifold of electrically insulating material that has a passage therethrough in-line between said coating material supply outlet and said reservoir, and said flushing means flushes said manifold passage to electrically isolate coating material in said reservoir from said coating material supply.

44. A system as in claim 41, including means for connecting the contents of said reservoir to ground potential whenever coating material in said reservoir is not being delivered to and electrostatically charged by the coating apparatus, and for disconnecting the contents from ground potential whenever coating material in said reservoir is being delivered to and electrostatically charged by the coating apparatus.

45. A system as in claim 41, including means for measuring the volume of coating material flowed from said coating material supply outlet and for controlling said coating material supply operating means to interrupt the flow when a preselected volume has been measured, whereby said preselected volume of coating material is supplied to said reservoir.

46. A system for supplying electrically conductive coating material to high voltage electrostatic coating apparatus, comprising a coating material supply having an outlet for the material; a reservoir connectable to the coating apparatus; coupling means connecting said coating material supply outlet to said reservoir; means for operating said coating material supply to flow coating material from said coating material supply outlet into and through said coupling means to and into said reservoir; means for flushing a portion of said coupling means between said coating material supply outlet and said reservoir, after flow of coating material from said coating material supply outlet through said coupling means to said reservoir, to electrically isolate coating material in said reservoir from said coating material supply; means, operative after coating material in said reservoir has been electrically isolated from said coating material supply, for delivering coating material in said reservoir to the coating apparatus for being electrostatically charged and emitted by the coating apparatus, whereby the high voltage at the coating apparatus is electrically isolated from said coating material supply; and means operable to connect the contents of said reservoir to ground potential whenever coating material in said reservoir is not being delivered to and electrostatically charged by the coating apparatus and to disconnect the contents from ground potential whenever coating material in said reservoir is being delivered to and electrostatically charged by the coating apparatus.

47. A system as in claim 46, including means, operative after said coating material supply flows coating material into and through said coupling means and prior to flushing at least a portion of said coupling means, for flowing a solvent for the coating material into said coupling means to push coating material remaining in said coupling means to and into said reservoir.

48. A system as in claim 47, wherein said coupling means has a known volumetric capacity and said means for flowing solvent flows into said coupling means a volume of solvent substantially equal to said known volumetric capacity.

49. A method of supplying electrically conductive coating material to high voltage electrostatic coating apparatus with a coating material supply having an outlet for the material, while maintaining electrical isolation between the high voltage at the coating apparatus and the coating material supply, said method comprising the steps of coupling the coating material supply outlet to a reservoir through a supply path; connecting the reservoir to the coating apparatus through a delivery path; operating the coating material supply to flow coating material from the coating material supply outlet into and through the supply path to and into the reservoir; after completion of said operating step, introducing a solvent for the coating material into the supply path to push coating material remaining in the supply path to and into the reservoir; after completion of said introducing step, flushing at least a portion of the supply path between the coating material supply outlet and reservoir to electrically isolate coating material in the reservoir from the coating material supply; and, after completion of said flushing step, delivering coating material in the reservoir through the delivery path to the coating apparatus for being electrostatically charged and emitted by the coating apparatus, whereby the high voltage at the coating apparatus is electrically isolated from the coating material supply.

50. A method as in claim 49, including the step of maintaining the coating material supply at ground potential.

51. A method as in claim 49, wherein said coupling step couples the coating material supply outlet to the reservoir through a supply path that includes a passage through a manifold of electrically insulating material, and said flushing step flushes the manifold passage.

52. A method as in claim 49, including the steps of connecting the contents of the reservoir to ground potential whenever coating material in the reservoir is not being delivered to and electrostatically charged by the coating apparatus, and disconnecting the contents of the reservoir from ground potential whenever coating material in the reservoir is being delivered to and electrostatically charged by the coating apparatus.

53. A method as in claim 49, including the steps of measuring the volume of coating material flowed from the coating material supply outlet during performance of said operating step, and interrupting performance of said operating step upon measuring a preselected volume of coating material flow.

54. A method as in claim 53, wherein the supply path has a known volumetric capacity, and including the steps of measuring the volume of solvent flowed into the supply path during performance of said introducing step, and interrupting performance of said introducing step when the measured volume flow is substantially equal to the known volumetric capacity.

55. A method of supplying electrically conducting coating material to high voltage electrostatic coating apparatus with a coating material supply having an outlet for the coating material, while maintaining electrical isolation between the high voltage at the coating apparatus and the coating material supply, said method comprising the steps of coupling the coating material supply outlet to a reservoir through a supply path; connecting the reservoir to the coating apparatus through a delivery path; operating the coating material supply to flow coating material from the coating material supply outlet into and through the supply path to and into the reservoir; after completion of said operating step, flushing at least a portion of the supply path between the coating material supply outlet and reservoir to electrically isolate coating material in the reservoir from the coating material supply; after completion of said flushing step, delivering coating material in the reservoir through the delivery path to the coating apparatus for being electrostatically charged and emitted by the coating apparatus, whereby the high voltage at the coating apparatus is electrically isolated from the coating material supply; and selectively connecting the contents of the reservoir to ground potential whenever coating material in the reservoir is not being delivered to and electrostatically charged by the coating apparatus and disconnecting the contents from ground potential whenever coating material in the reservoir is being delivered to and electrostatically charged by the coating apparatus.

56. A method as in claim 55, including the step, after said operating step and prior to said flushing step, of introducing a solvent for the coating material into the supply path to push coating material remaining in the supply path to and into the reservoir.

57. A method as in claim 56, wherein the supply path has a known volumetric capacity, and including the steps of measuring the volume flow of coating material from the coating material supply outlet into the supply path during performance of said operating step and interrupting performance of said operating step in response to the measured volume flow of coating material equaling a selected volume, and measuring the volume flow of solvent into the supply path during performance of said introducing step and interrupting performance of said introducing step upon the measured volume flow of solvent being substantially equal to the known volumetric capacity.

* * * * *